US009926150B2

(12) United States Patent
Matsushima

(10) Patent No.: US 9,926,150 B2
(45) Date of Patent: Mar. 27, 2018

(54) SHEET FEEDING APPARATUS AND IMAGE FORMING APPARATUS INCLUDING THE SAME

(71) Applicant: CANON KABUSHIKI KAISHA, Tokyo (JP)

(72) Inventor: Akira Matsushima, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/608,719

(22) Filed: May 30, 2017

(65) Prior Publication Data

US 2017/0260013 A1 Sep. 14, 2017

Related U.S. Application Data

(63) Continuation of application No. 15/007,608, filed on Jan. 27, 2016, now abandoned.

(30) Foreign Application Priority Data

Jan. 29, 2015 (JP) ..... 2015-014887

(51) Int. Cl.

| | |
|---|---|
| ***B65H 1/00*** | (2006.01) |
| ***B65H 1/26*** | (2006.01) |
| ***B65H 1/04*** | (2006.01) |
| *G03G 15/00* | (2006.01) |

(52) U.S. Cl.

CPC ..... *B65H 1/266* (2013.01); *B65H 1/04* (2013.01); *B65H 2402/32* (2013.01); *B65H 2402/35* (2013.01); *B65H 2405/11425* (2013.01); *B65H 2405/12* (2013.01); *B65H 2511/11* (2013.01); *B65H 2511/12* (2013.01); *B65H 2511/30* (2013.01); *G03G 15/6505* (2013.01)

(58) Field of Classification Search

CPC . B65H 1/04; B65H 1/26; B65H 1/266; B65H 9/04; B65H 9/101; B65H 2402/30; B65H 2402/31; B65H 2402/32; B65H 2402/35; B65H 2403/40; B65H 2402/41; B65H 2405/10; B65H 2405/11; B65H 2405/112; B65H 2405/1124; B65H 2405/114; B65H 2405/1142; B65H 2405/11425; B65H 2405/1144; B65H 2405/115; B65H 2405/12; B65H 2405/121; B65H 2405/31; B65H 2405/32; B65H 2511/00; B65H 2511/10; B65H 2511/11; B65H 2511/12

See application file for complete search history.

(56) References Cited

U.S. PATENT DOCUMENTS 6,669,188 B1 * 12/2003 Marasco ..... B65H 1/04 271/145
2004/0188922 A1 * 9/2004 Takahashi ..... B65H 1/04 271/145

(Continued)

*Primary Examiner* — Prasad V Gokhale
(74) *Attorney, Agent, or Firm* — Canon U.S.A., Inc. IP Division

(57) ABSTRACT

The present invention provides a sheet feeding apparatus capable of feeding sheets at a proper position without a regulating member being bent even if a cassette unit is closed in a state in which a large volume of sheets are stacked. A large-volume feeding deck includes a non-reference-side regulating plate, an external casing plate, and positioning members, which are movable relative to the cassette unit.

8 Claims, 15 Drawing Sheets

(56) References Cited

U.S. PATENT DOCUMENTS

| | | | | |
|---|---|---|---|---|
| 2007/0069450 | A1* | 3/2007 | Kawanishi | B65H 1/266 271/162 |
| 2014/0217667 | A1* | 8/2014 | Doshida | B65H 1/266 271/162 |
| 2017/0003635 | A1* | 1/2017 | Koga | G03G 15/6511 |

* cited by examiner

SHEET FEEDING APPARATUS AND IMAGE FORMING APPARATUS INCLUDING THE SAME

The present application is a continuation of U.S. patent application Ser. No. 15/007,608, filed Jan. 27, 2016, entitled "SHEET FEEDING APPARATUS AND IMAGE FORMING APPARATUS INCLUDING THE SAME", the content of which is expressly incorporated by reference herein in its entirety. Further, the present application claims priority from Japanese Patent Application No. 2015-014887, Jan. 29, 2015, which is also hereby incorporated by reference herein in its entirety.

BACKGROUND OF THE INVENTION

Field of the Invention

The present invention relates to a sheet feeding apparatus and an image forming apparatus including the sheet feeding apparatus.

Description of the Related Art

Known image forming apparatuses in the related art for forming an image on a sheet, such as a printer, a facsimile machine, a copying machine, and a compound machine thereof, include a sheet feeding apparatus for feeding sheets in a cassette to an image forming unit. An example of the sheet feeding apparatus includes an intermediate plate on which sheets are stacked and side regulating members that move in a direction perpendicular to a sheet feeding direction (hereinafter referred to as "width direction") to regulate the side edges of the sheets. The side regulating members on both sides of the sheets are moved to predetermined positions according to the size of the sheets. Thus, the sheets are positioned.

An example of a method for positioning side regulating members of known sheet feeding apparatuses for regulating the positions of the side edges of sheets is an insertion method for inserting the regulating members into insertion holes formed at predetermined positions. Another example disclosed in Japanese Patent Laid-Open No. 2000-309431 is a sliding method for positioning regulating members on both sides of the sheets, which are connected together with a belt and are slidable only in sheet regulating directions, in the sheet width directions by sliding the regulating members in opposite directions by the same amount of movement.

The insertion method of inserting the regulating members into insertion holes require much time and effort because changing the sheet size needs to detach the regulating members from the insertion holes and again insert the regulating members into other insertion positions at predetermined positions.

Apparatuses using the sliding method are easy to operate since they allows the positions of the regulating members to be changed only by sliding the regulating members, as disclosed in Japanese Patent Laid-Open No. 2000-309431.

However, the apparatuses using the sliding system need to move the side regulating members disposed at the inner part of the apparatuses and opposing an operating unit with an operation on the operating unit and is liable to cause bending at contact portions that are in contact with the side regulating members.

In particular, in a configuration in which a cassette unit can be inserted into and extracted from an apparatus main body, side regulating members are disposed in front of and behind the cassette unit in the drawing direction. Furthermore, an operating unit is sometimes disposed at the front of the cassette unit for ease of operation. In this case, if the user places a large volume of sheets in the cassette unit and closes the cassette unit with strength, the side regulating member at the inner part of the apparatus may be pushed by an inertial force acting on the cassette unit due to the weight of the placed sheet bundle to be bent. When the side regulating member at the inner part of the apparatus is pushed to be bent, it is difficult to properly position the sheet bundle with the side regulating member.

SUMMARY OF THE INVENTION

The present invention provides a sheet feeding apparatus capable of feeding a large volume of sheets at an proper position by preventing a regulating member from being bent even if a cassette unit in which a large volume of sheets are stacked is moved with strength.

According to a first aspect of the present invention, a sheet feeding apparatus includes an apparatus main body, a cassette unit, and a positioning member. The cassette unit is detachable from the apparatus main body and is configured to hold a stack of sheets. The cassette unit includes a regulating member that regulates an edge of at least one side of the sheets stacked in the cassette unit and an external member forming an outer surface of the apparatus main body. The positioning member is configured to position the cassette unit relative to the apparatus main body. The regulating member, the external member, and the positioning member can be individually moved relative to the cassette unit.

According to a second aspect of the present invention, an image forming apparatus includes an apparatus main body, a cassette unit, and a positioning member. The apparatus main body includes an image forming unit that forms a toner image. The cassette unit is detachable from the apparatus main body and is configured to hold a stack of sheets. The cassette unit includes a regulating member that regulates an edge of at least one side of the sheets stacked in the cassette unit and an external member forming an outer surface of the apparatus main body. The positioning member is configured to position the cassette unit relative to the apparatus main body. The regulating member, the external member, and the positioning member can be individually moved relative to the cassette unit.

Further features of the present invention will become apparent from the following description of exemplary embodiments with reference to the attached drawings.

DESCRIPTION OF THE EMBODIMENTS

An image forming apparatus including a sheet feeding apparatus according to an embodiment of the present invention will be specifically described with reference to the drawings.

First Embodiment

Referring first to FIG. 1 to FIGS. 9A and 9B, an image forming apparatus including a sheet feeding apparatus according to a first embodiment of the present invention will be described.

Image Forming Apparatus

Figure 1:
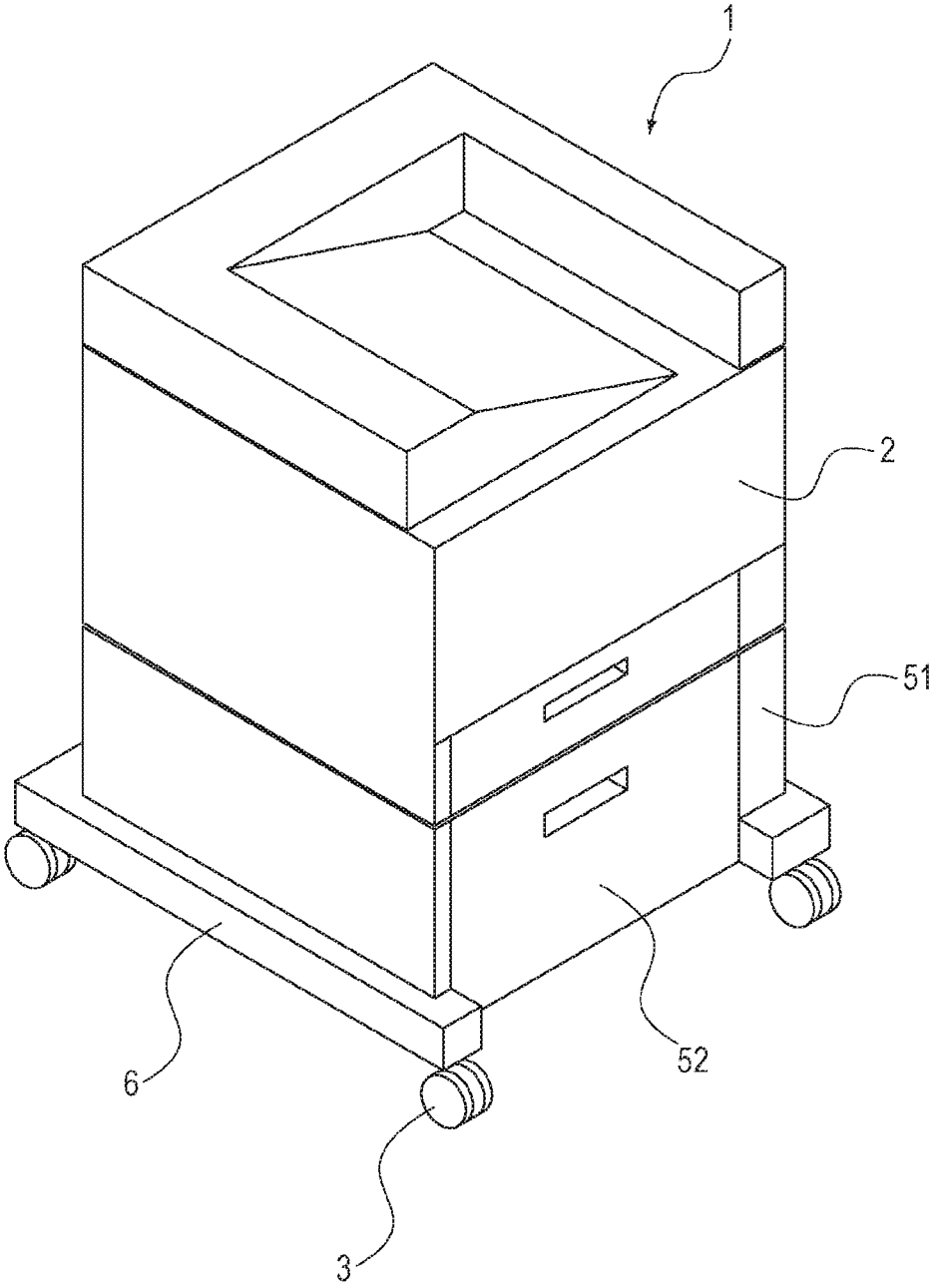
FIG. 1 is a perspective view of an image forming apparatus including a sheet feeding apparatus according to an embodiment of the present invention illustrating the general arrangement thereof.
Figure 2:
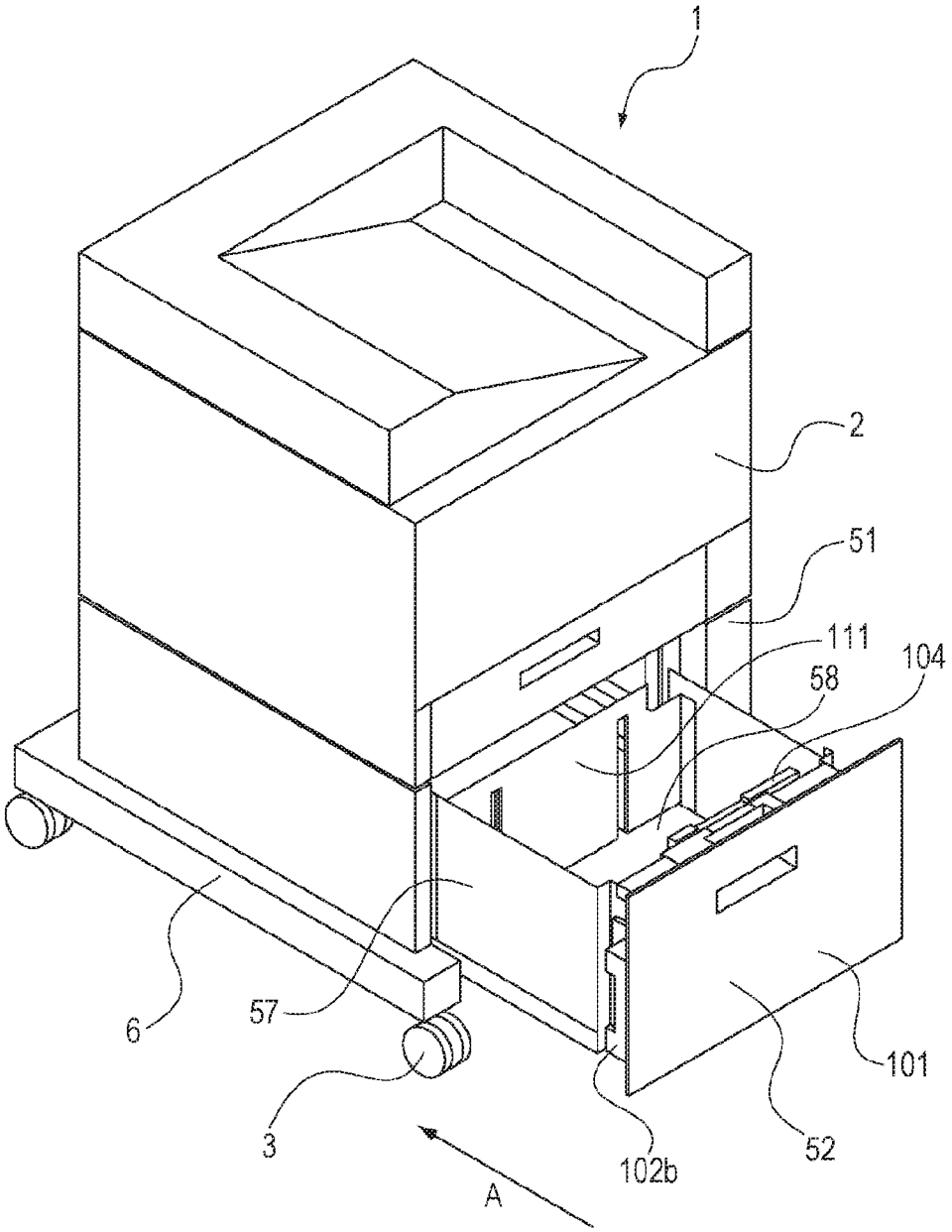
FIG. 2 is a perspective view of the image forming apparatus in a state in which a cassette unit is drawn from the sheet feeding apparatus.
Figure 3:
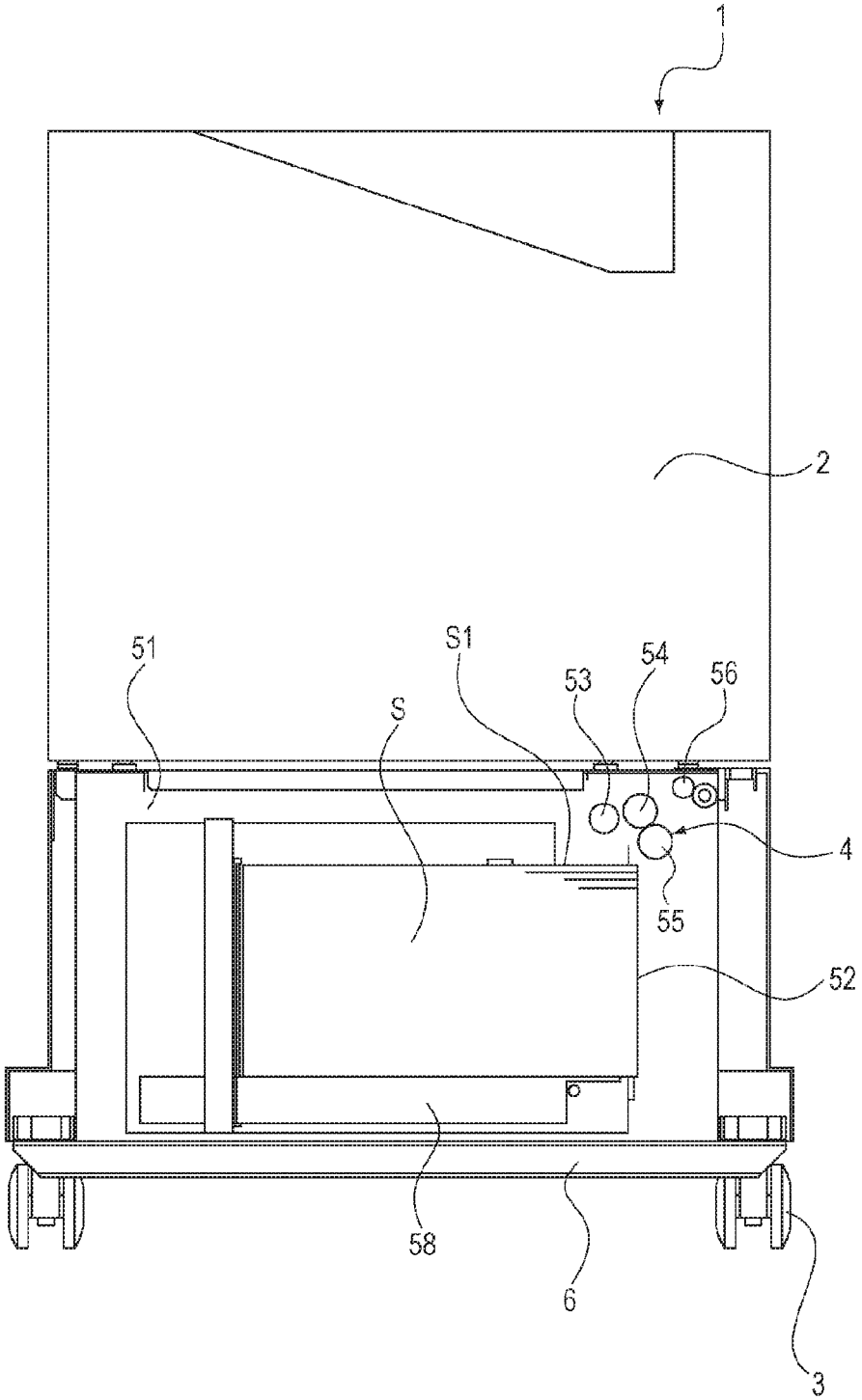
FIG. 3 is a cross-sectional view of the image forming apparatus illustrating the configuration of a sheet feeding unit in the image forming apparatus.

Referring to FIG. 1 to FIG. 3, the configuration of an image forming apparatus 1 including a large-volume feeding deck 51, which is a sheet feeding apparatus according to an embodiment of the present invention, at the lower part will be described. FIG. 1 is a perspective view of the image forming apparatus 1 including the large-volume feeding deck 51 at the lower part illustrating the general arrangement thereof. FIG. 2 is a perspective view of the image forming apparatus 1 illustrating a state in which a cassette 52 (a cassette unit) is drawn from the large-volume feeding deck 51 (an apparatus main body). FIG. 3 is a cross-sectional view of the image forming apparatus 1 illustrating the configuration of a sheet feeding unit of the large-volume feeding deck 51.

The first embodiment shown in FIG. 1 to FIG. 3 is an example in which the large-volume feeding deck 51 serving as a sheet feeding apparatus is disposed at the lower part the image forming apparatus 1, which is a laser beam printer (LBP). As shown in FIG. 1 to FIG. 3, the image forming apparatus 1 according to this embodiment includes, at the top of the large-volume feeding deck 51, an image forming unit 2 for forming an image on sheets S fed from the large-volume feeding deck 51.

The image forming unit 2 is a known image forming unit. The image forming unit 2 includes an image bearing member for bearing a static latent image according to image information (not shown). The image forming unit 2 further includes a charging unit that uniformly charges the surface of the image bearing member. The image forming unit 2 further includes an image exposing unit that irradiates the surface of the image bearing member charged by the charging unit with light according to the image information to form a static latent image.

The image forming unit 2 further includes a developing unit that supplies a developer (toner) to the static latent image formed on the surface of the image bearing member to develop an image. The image forming unit 2 further includes a transfer unit that transfers the toner image formed on the surface of the image bearing member to the sheets S. The image forming unit 2 further includes a cleaning unit that scrapes toner remaining on the surface of the image bearing member after transferring the toner image to clean the surface of the image bearing member.

Sheet Feeding Unit

Referring to FIG. 1 to FIG. 3, the configuration of the large-volume feeding deck 51 serving as the sheet feeding apparatus according to the embodiment of the present invention will be described. As shown in FIG. 1 to FIG. 3, the large-volume feeding deck 51 according to this embodiment is disposed at the lower part of the image forming apparatus 1 and serves also as a mount for the image forming apparatus 1 main body. Legs 6 of the large-volume feeding deck 51 are fitted with four casters 3 (wheels) in consideration of movement in a state in which the image forming apparatus 1 main body is mounted thereon.

As shown in FIG. 3, the large-volume feeding deck includes a transport roller 53 that transports the sheets S1 stacked on an intermediate plate 58 as a sheet feeding unit by coming into contact with a sheet S1 on the top of the sheets S. The large-volume feeding deck 51 further includes a separating roller unit 4 including a feed roller 54 and a retard roller 55 that separately feed the sheets S taken out by the transport roller 53. The large-volume feeding deck 51 further includes conveying rollers 56 that convey the sheets S separately fed by the separating roller unit 4 one by one to a conveying path in the image forming apparatus 1 main body.

The large-volume feeding deck 51 includes a cassette 52 which can be inserted into and extracted from the large-volume feeding deck 51 and in which the sheets S are stacked on the intermediate plate 58. Sheets S of a variety of sizes and basis weights can be stacked on the intermediate plate 58 of the cassette 52 and can be fed to the conveying path in the image forming apparatus 1 main body.

When the large-volume feeding deck 51 receives a sheet feed signal from a control unit (not shown) disposed in the image forming apparatus 1 main body, a wire take-up shaft 63 (see FIG. 4) is rotated by a motor 62 (see FIG. 5) serving as a driving source to wind a wire 59 to move the intermediate plate 58 secured to the wire 59 up and down. Furthermore, the transport roller 53, the separating roller unit 4, and the conveying rollers 56, which form the sheet feeding unit, feed the sheets S stacked on the intermediate plate 58 in the cassette 52 to the image forming apparatus 1 main body one by one.

Sheet Feeding Unit

Figure 4:
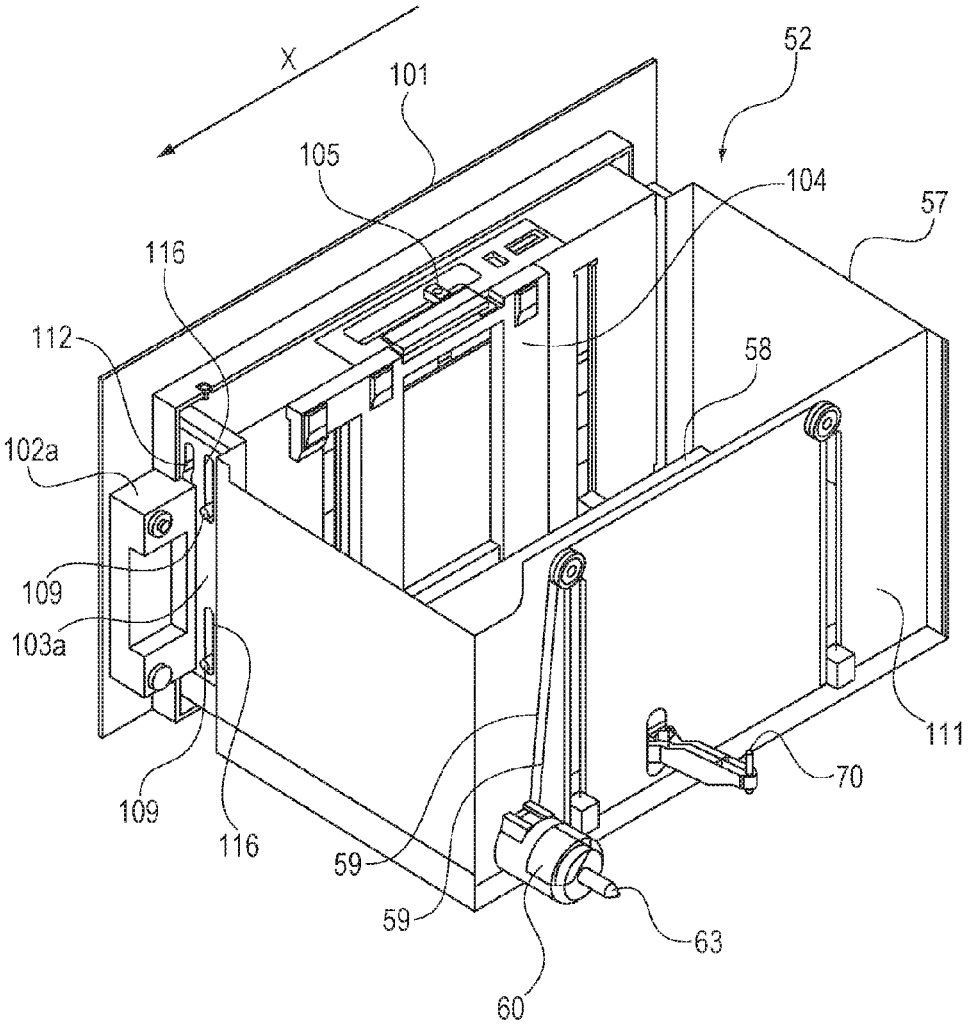
FIG. 4 is a perspective view of the cassette unit that can be inserted into and extracted from the sheet feeding apparatus main body according to a first embodiment of the present invention.
Figure 5:
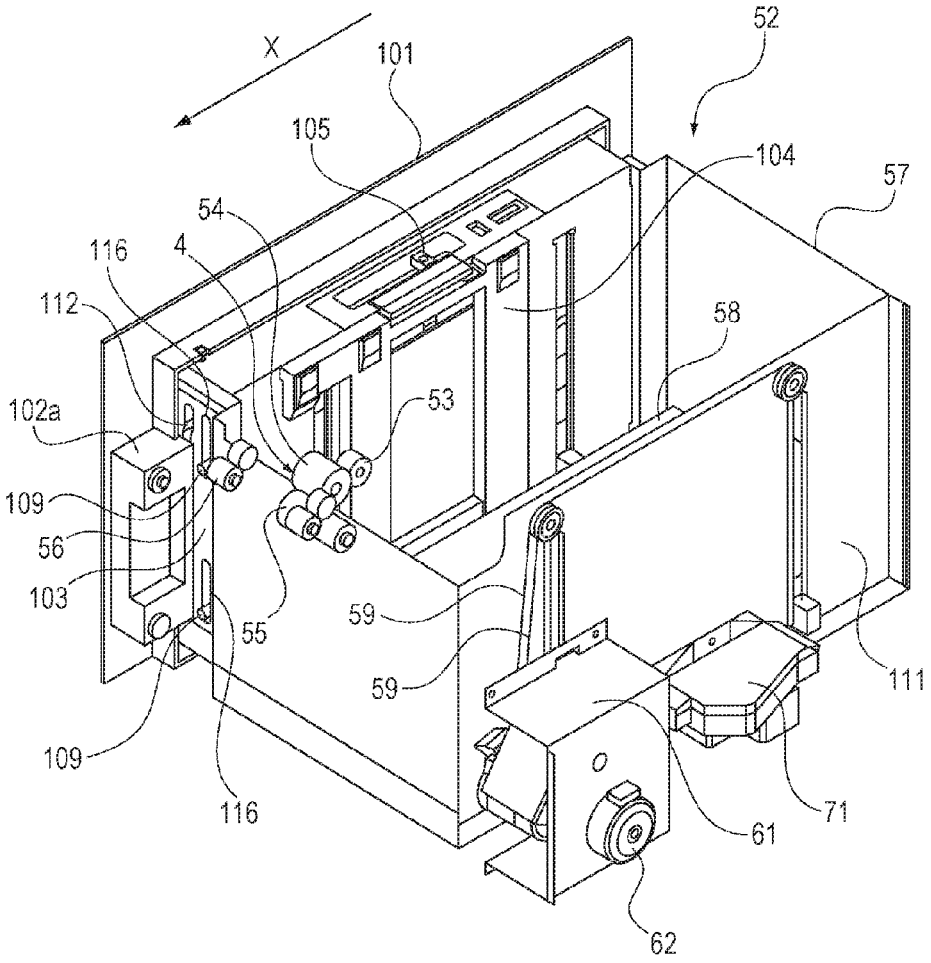
FIG. 5 is a perspective view of the cassette unit mounted to the sheet feeding apparatus main body in the first embodiment.

Referring next to FIG. 1 to FIGS. 6A and 6B, the configuration of the sheet feeding unit and the cassette 52 disposed in the large-volume feeding deck 51 will be described. As shown in FIG. 1 to FIG. 3, the large-volume feeding deck 51 includes the cassette 52 in which the sheets S are stacked on the intermediate plate 58. As shown in FIG. 3 to FIG. 5, the cassette 52 includes the intermediate plate 58 serving as a sheet mount, on which the sheets S are to be stacked. The intermediate plate 58 can be moved up and down by the wire 59 serving as a lifter.

The highest sheet S1 of the bunch of sheets S stacked on the intermediate plate 58 is moved to a position in contact with the transport roller 53 (see FIG. 3 and FIG. 5) and is fed by the rotation of the transport roller 53. The sheet S fed by the transport roller 53 is separately fed by the operation of the feed roller 54 and the retard roller 55 constituting the separating roller unit 4. The sheet S separately fed by the separating roller unit 4 is nipped by the conveying rollers 56 and conveyed to the conveying path in the image forming apparatus 1 main body.

The intermediate plate 58 is hung by the wire 59, as shown in FIG. 4 and FIG. 5. The wire 59 can be wound around the wire take-up shaft 63 shown in FIG. 4. A gear 60 attached to the wire take-up shaft 63 can be engaged with a gear (not shown) of a lifter driving unit 61 disposed in the large-volume feeding deck 51 (see FIG. 5). The wire 59 is wound around the wire take-up shaft 63 by rotating the motor 62 disposed in the lifter driving unit 61. This allows the intermediate plate 58 to be moved upward (lifted) in FIG. 3 to FIG. 5.

As shown in FIG. 1 and FIG. 2, the cassette 52 can be inserted into and extracted from the large-volume feeding deck 51 by the user when the user stacks the sheets S on the intermediate plate 58 in the cassette 52. As shown in FIG. 2, when the cassette 52 is drawn from the large-volume feeding deck 51, the connection between the gear (not shown) in the lifter driving unit 61 (see FIG. 5) and the gear 60 in the cassette 52 (see FIG. 4) is released. This causes the intermediate plate 58 to move to the lowest position (see FIG. 2 and FIG. 3) because of its self weight.

As shown in FIG. 2, the sheets S are stacked on the intermediate plate 58 in a state in which the cassette 52 is drawn from the large-volume feeding deck 51, and the cassette 52 is inserted into the large-volume feeding deck 51. This causes a drawing pin 70 disposed in the cassette (see FIG. 4 and FIGS. 6A and 6B) to engage with a drawing mechanism 71 disposed in the large-volume feeding deck 51 (see FIG. 5 and FIGS. 6A and 6B).

Figure 6A:
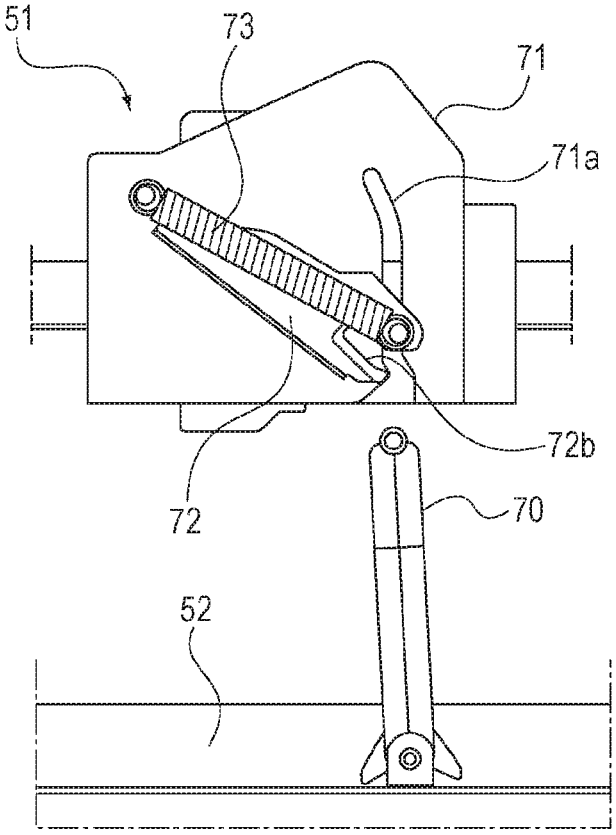
FIG. 6A is a cross-sectional view of a drawing mechanism in a state in which the cassette unit is drawn.
Figure 6B:
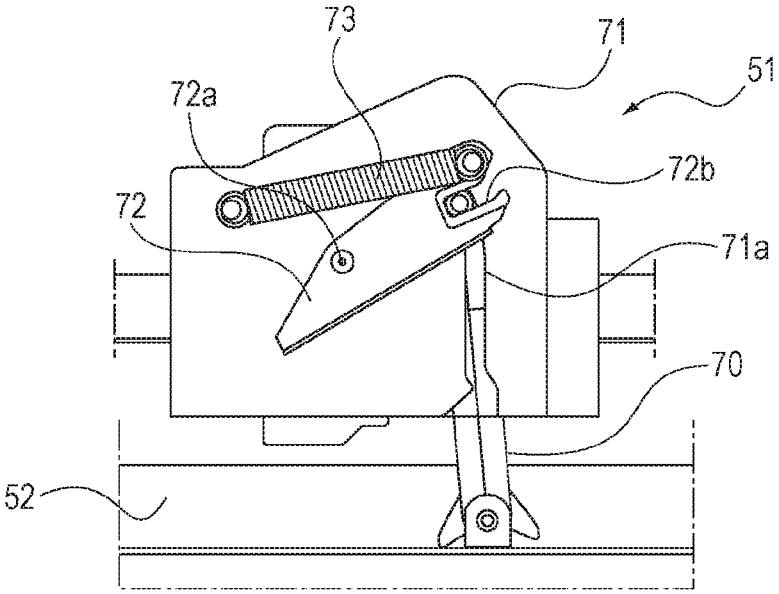
FIG. 6B is a cross-sectional view of the drawing mechanism in a state in which the cassette unit is inserted.

The drawing mechanism 71 accommodates a hook 72 and a spring 73 serving as an urging unit (see FIGS. 6A and 6B). When the cassette 52 (see FIG. 5) is inserted, the drawing pin 70 in the cassette 52 is inserted into an engaging groove 72*b* of the hook 72 of the drawing mechanism 71 disposed in the large-volume feeding deck 51, as shown in FIG. 6B. The drawing pin 70 comes into contact with the inner wall surface of the engaging groove 72*b* to rotate the hook 72 counterclockwise in FIG. 6B about a rotation center 72*a* with pressure against the tensile force of the spring 73 in the state shown in FIG. 6A.

When the hook 72 rotates about the rotation center 72*a* by a predetermined angle counterclockwise in FIG. 6B, the drawing pin 70 is drawn into the drawing mechanism 71 along a guide groove 71*a* by the tensile force of the spring 73. This causes the cassette 52 to be drawn in the inserting direction indicated by arrow A in FIG. 2.

This brings positioning members 102*a* and 102*b* for positioning the cassette 52 relative to the large-volume feeding deck 51 (see FIG. 4, FIG. 5, and FIGS. 9A and 9B) into contact with a frame 51*a* of the large-volume feeding deck 51. This causes the cassette 52 to be mounted at a predetermined position in the large-volume feeding deck 51. At that time, the gear (not shown) of the lifter driving unit 61 disposed in the large-volume feeding deck 51 (see FIG. 5) and the gear 60 in the cassette 52 (see FIG. 4) come into engagement with each other.

A detection unit (not shown) detects that the cassette 52 is mounted in the large-volume feeding deck 51. A control unit (not shown) rotationally drives the motor 62 of the lifter driving unit 61 (see FIG. 5) on the basis of a detection signal from the detection unit (not shown). This causes the wire take-up shaft 63, to which the gear 60 is secured (see FIG. 4), to rotate to wind the wire 59.

This causes the intermediate plate 58 connected to the wire 59 to be moved up. The control unit (not shown) stops the rotation of the motor 62 of the lifter driving unit 61 (see FIG. 5) on the basis of a detection signal from a sheet-surface detection unit (not shown). This causes the rotation of the motor 62 of the lifter driving unit 61 (see FIG. 5) to be stopped at the timing when the surface of the highest sheet S1 of the sheets S stacked on the intermediate plate 58 comes into contact with the transport roller 53.

The control unit (not shown) rotates the transport roller 53, the separating roller unit 4, and the conveying rollers 56 (see FIG. 3 and FIG. 5) by rotating a motor serving as a driving source (not shown). This causes the highest sheet S1 of the sheets S stacked on the intermediate plate 58 in the cassette 52 to be taken out by the transport roller 53 into the nip of the separating roller unit 4 constituted by the feed roller 54 and the retard roller 55 and is separately fed.

The control unit (not shown) controls the motor 62 of the lifter driving unit 61 (see FIG. 5) so as to rotate so that the highest sheet S1 of the sheets S stacked on the intermediate plate 58 in the cassette 52 moves to a position at which the sheet S1 comes into contact with the transport roller 53 and is held at the position.

When a sheet feed signal is sent from the image forming apparatus 1 main body, the transport roller 53 rotates in contact with the highest sheet S1 of the sheets S on the intermediate plate 58. This causes the highest sheet S1 on the intermediate plate 58 to be fed to the nip of the separating roller unit 4 constituted by the feed roller 54 and the retard roller 55 disposed downstream from the transport roller 53 (see FIG. 3). The separating roller unit 4 separates the sheet S fed by the transport roller 53 using the feed roller 54 rotating in the feeding direction and the retard roller 55 rotating in the backward direction and transfers the sheet S to the conveying rollers 56.

The sheet S is then conveyed between the conveying rollers 56 to the image forming unit 2 in the image forming apparatus 1 main body through the conveying path (not shown) connecting the large-volume feeding deck 51 main body and the image forming apparatus 1 main body together. The sheets S are sent to the image forming apparatus 1 main body one by one by repeating the above feeding operation every time a sheet feed signal is sent from the image forming apparatus 1 main body.

Regulating Member

As shown in FIG. 4 and FIG. 5, the cassette 52 includes a non-reference-side regulating plate 104 serving as a regulating member, which is movable relative to the cassette 52. The non-reference-side regulating plate 104 regulates the end of at least one side of the sheets S stacked on the intermediate plate 58 disposed so as to be moved up and down in the cassette 52.

In FIG. 4 and FIG. 5, a reference-side regulating plate 111 serving as a side regulating member that regulates the widthwise position of one side of the sheets S on the intermediate plate 58 serving as a sheet mount. The reference-side regulating plate 111 is secured to a casing 57 of the cassette 52. Accordingly, the reference-side regulating plate 111 is disposed at a fixed position relative to the cassette 52.

In FIG. 4 and FIG. 5, the non-reference-side regulating plate 104 is a side regulating member including a width changing plate. The position in the sheet width direction of the sheets S on the intermediate plate 58 disposed so as to be moved up and down in the cassette 52 is regulated by the contact of the reference-side regulating plate 111 and the non-reference-side regulating plate 104 with both sides of the sheets S.

The reference-side regulating plate 111 and the non-reference-side regulating plate 104 are opposed to each other on the intermediate plate 58. The reference-side regulating plate 111 is disposed at a fixed position. The non-reference-side regulating plate 104 is movable in the sheet width direction.

Referring to FIG. 4 and FIG. 5, an operating lever 105 is an operating member disposed at one side of the periphery of the cassette 52. The operating lever 105 is disposed at the upper end of a shaft 106 (see FIGS. 7A and 7B). A holder member 8 rotatable about a rotation shaft 8*a* supported by the casing 57 of the cassette 52 is secured to the center of the shaft 106 in the longitudinal direction. A rhomboid rotation member 107, which is long in the longitudinal direction (in the lateral direction in FIGS. 7A and 7B), is secured to the holder member 8.

Both ends of the rotation member 107 in the longitudinal direction are slidably disposed in slits 5, which are rectangular parallelepiped through-holes (elongate holes), provided in vertically sliding members 103*a* and 103*b*.

This causes the operating lever 105 to be connected to the positioning members 102*a* and 102*b* that position the cassette 52 relative to the large-volume feeding deck 51 main body via connecting members. The connecting members include the shaft 106, the rotation member 107, and the vertically sliding members 103*a* and 103*b* shown in FIGS. 7A and 7B.

As shown in FIG. 4 and FIG. 5, the cassette 52 includes a movable external casing plate 101 serving as an external member that covers the front surface of the large-volume feeding deck 51 main body.

The non-reference-side regulating plate 104 serving as a regulating member, an external casing plate 101 serving as an external member, and the positioning members 102*a* and 102*b* are movable relative to the cassette 52.

Figure 7A:
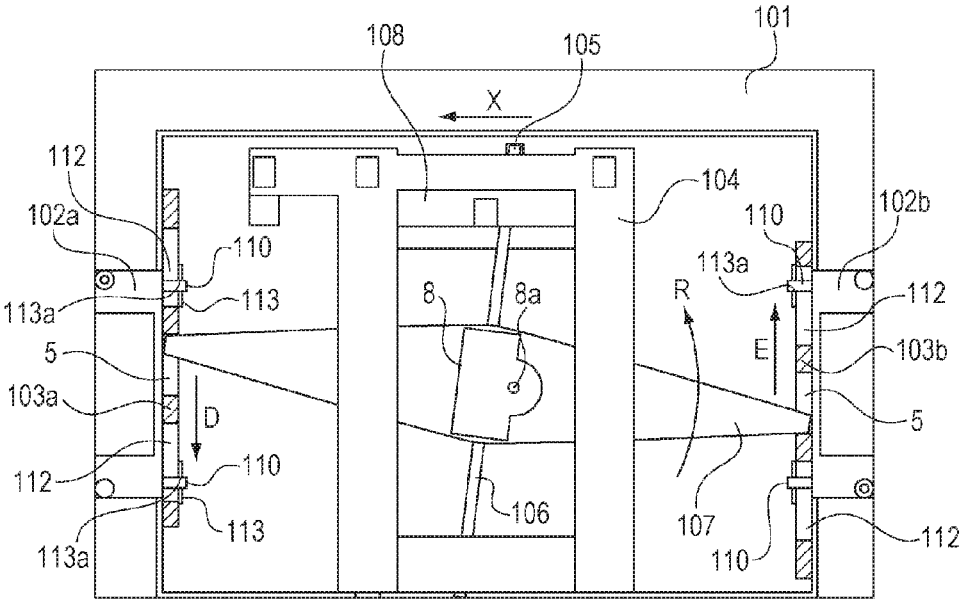
FIG. 7A is a cross-sectional view of connecting members setting for LTR size in the first embodiment.
Figure 7B:
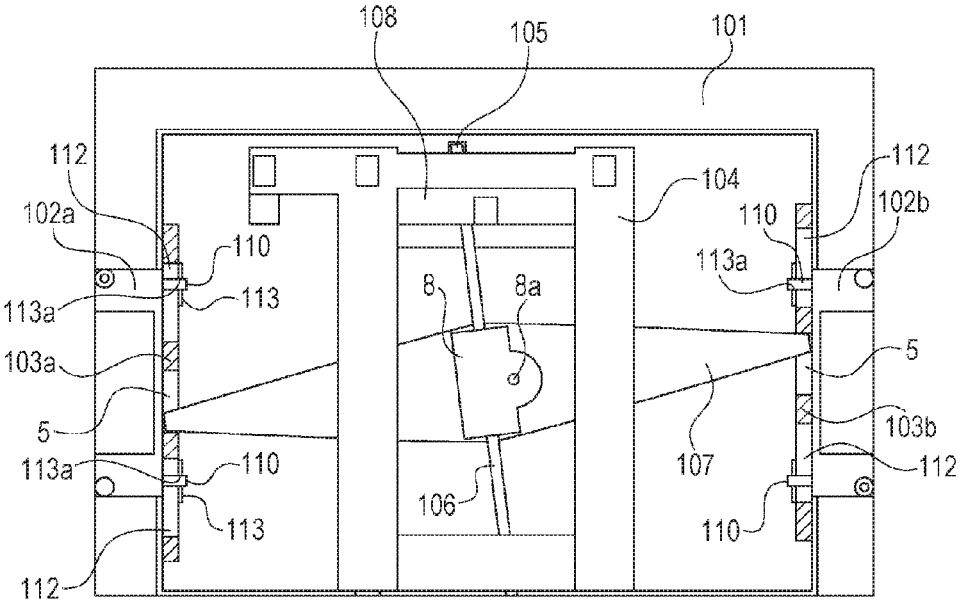
FIG. 7B is a cross-sectional view of the connecting members setting for A4 size in the first embodiment.

When the user moves the operating lever 105 in the direction of the arrow X (or in the opposite direction from the arrow X) in FIG. 4 and FIG. 5, the non-reference-side regulating plate 104, the external casing plate 101, and the positioning members 102*a* and 102*b* can be individually moved relative to the cassette 52 via the shaft 106, the rotation member 107, and the vertically sliding members 103*a* and 103*b* serving as connecting members (see FIGS. 7A and 7B).

This allows, when the user sets a predetermined sheet size by appropriately moving the operating lever 105 in the direction of arrow X (or in the direction opposite to the arrow X) in FIG. 4 FIG. 5, the non-reference-side regulating plate 104, the external casing plate 101, and the positioning members 102*a* and 102*b* are operatively connected to be positioned at predetermined positions.

Figure 9A:
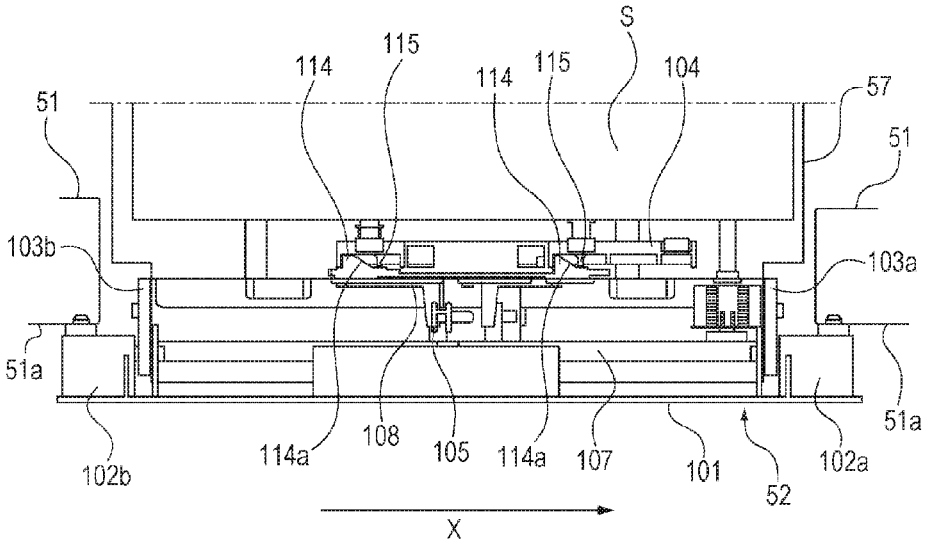
FIG. 9A is a cross-sectional view of the cassette unit set for LTR size in the first embodiment.
Figure 9B:
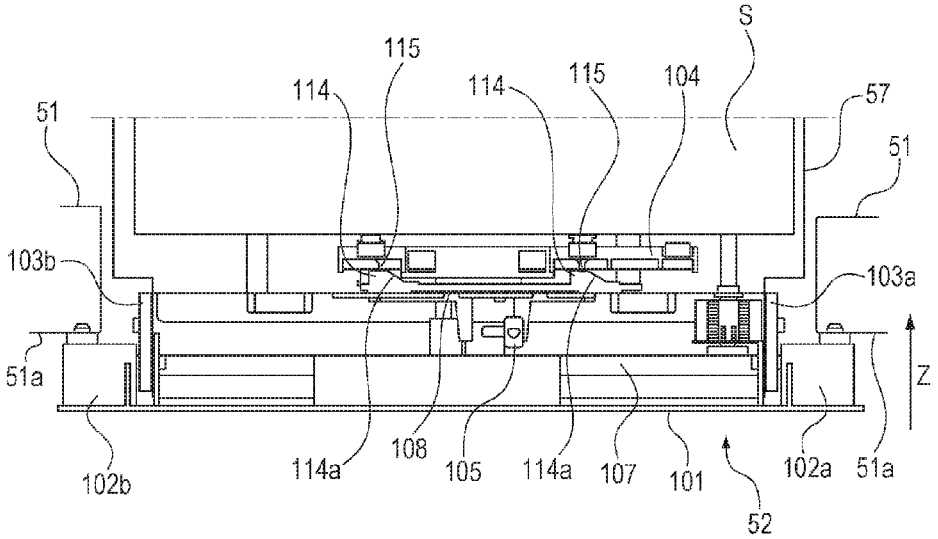
FIG. 9B is a cross-sectional view of the cassette unit set for A4 size in the first embodiment.

The non-reference-side regulating plate 104, the external casing plate 101, and the positioning members 102*a* and 102*b* move in the direction in which the cassette 52 is inserted into the large-volume feeding deck 51 main body (in the vertical direction in FIGS. 9A and 9B).

The non-reference-side regulating plate 104 (see FIG. 4 and FIG. 5) moves in a direction facing the reference-side regulating plate 111 (in the sheet width direction) as the operating lever 105 is operated by the user. This allows the size of the sheets S to be stacked on the intermediate plate 58 in the cassette 52 to be changed.

The intermediate plate 58 serving as a sheet mount according to this embodiment allows sheets S of LTR (Letter) size (279.4 mm×215.9 mm) with a width of about 216 mm to be stacked. The intermediate plate 58 also allows sheets S of A4 size (297 mm×210 mm) with a width of 210 mm to be stacked.

Thus, sheets S of two kinds of widths can be stacked on the intermediate plate 58. Both sides of the sheets S in the width direction are brought into contact with the non-reference-side regulating plate 104, which is movable along the width of the sheets S, and the reference-side regulating plate 111 disposed at a fixed position. Thus, the positions of the both sides of the sheets S in the width direction can be regulated.

FIGS. 7A and 7B are cross-sectional views of the cassette 52 illustrating the configuration of the connecting members for moving the non-reference-side regulating plate 104 disposed at the front of the cassette 52, the external casing plate 101, and the positioning members 102*a* and 102*b*. FIG. 7A illustrates a case in which the sheets S stacked on the intermediate plate 58 in the cassette 52 is of LTR size. FIG. 7B illustrates a case in which the sheets S stacked on the intermediate plate 58 in the cassette 52 is of A4 size.

Referring to FIGS. 7A and 7B, the rhomboid rotation member 107 constituting a connecting member is held by the holder member 8 that holds a substantially central portion in the longitudinal direction of the shaft 106 provided with the operating lever 105. The holder member 8 is rotatably supported about the rotation shaft 8*a* supported by the casing 57 of the cassette 52.

When the user moves the operating lever 105 in the direction of arrow X in FIG. 7A (or in the opposite direction from arrow X), the shaft 106 of the operating lever 105 and the rotation member 107 rotate together about the rotation shaft 8*a* in the direction of arrow R in FIG. 7A (or in the opposite direction from arrow R).

As shown in FIGS. 7A and 7B and FIGS. 8A to 8D, the vertically sliding members 103*a* and 103*b* movable in the vertical direction in FIGS. 7A and 7B are disposed at positions corresponding to the both ends of the rhomboid rotation member 107 (in the lateral direction in FIGS. 7A and 7B). As shown in FIGS. 8A to 8D, the vertically sliding members 103*a* and 103*b* each have the slit 5, which is a rectangular through-hole, disposed in the vertical direction in FIGS. 8A to 8D.

Both ends of the rotation member 107 in the longitudinal direction are slidably disposed in the slits 5 in the vertically sliding members 103*a* and 103*b*. This allows the both ends in the longitudinal direction of the rotation member 107 that rotates about the rotation shaft 8*a* to be engaged with the vertically sliding members 103*a* and 103*b* via the slits 5.

For example, when the rotation member 107 rotates about the rotation shaft 8*a* in the direction of arrow R in FIG. 7A as the user moves the operating lever 105 in the direction of arrow X in FIG. 7A, the vertically sliding members 103*a* and 103*b* respectively move in the directions of arrows D and E in FIG. 7A together with the rotation of the rotation member 107.

As shown in FIG. 4 and FIG. 5, the external casing plate 101 and the positioning members 102*a* and 102*b* are secured to each other. Shafts 110 projecting from the positioning members 102*a* and 102*b* (see FIGS. 7A and 7B) are slidably disposed in slits 112, which are cam grooves passing through the vertically sliding members 103*a* and 103*b* (see FIGS. 8A to 8D). As shown in FIGS. 7A and 7B, the ends of the shafts 110 are securely fitted in through-holes 113*a* disposed in supporting portions 113 secured to the external casing plate 101.

The pair of upper and lower shafts 110 secured to the external casing plate 101 are slidably disposed in the pair of upper and lower slits 112, or cam grooves, formed in each of the vertically sliding members 103*a* and 103*b*. The vertically sliding members 103*a* and 103*b* are supported movably in the vertical direction in FIGS. 7A and 7B as the shafts 110 slides in the slits 112.

As shown in FIGS. 7A and 7B, the shaft 106 of the operating lever 105 includes a laterally sliding member 108 engageable with the non-reference-side regulating plate 104. For example, when the user moves the operating lever 105 in the direction of arrow X in FIG. 7A, the laterally sliding member 108 moves in the direction of arrow X in FIG. 7A together with the movement.

Sheet-Size Changing Operation

Referring to FIGS. 7A and 7B and FIGS. 8A to 8D, how the non-reference-side regulating plate 104, the external casing plate 101, and the positioning members 102*a* and 102*b* move as the user operates the operating lever 105 will be described. The user operates the operating lever 105 to change the size of the sheets S stacked on the intermediate plate 58 in the cassette 52.

As the operating lever 105 is operated, the non-reference-side regulating plate 104, the external casing plate 101, and the positioning members 102*a* and 102*b* operate. In this embodiment, an operation for changing the sheets S of LTR size (see FIG. 7A and FIGS. 8A and 8B) to the sheets S of A4 size (see FIG. 7B and FIGS. 8C and 8D) will be described.

Figure 8A:
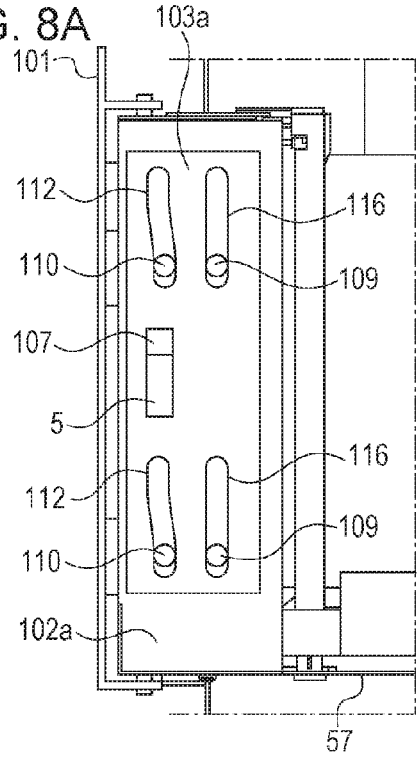
FIG. 8A is a cross-sectional view of an external member setting for LTR size in the first embodiment.
Figure 8B:
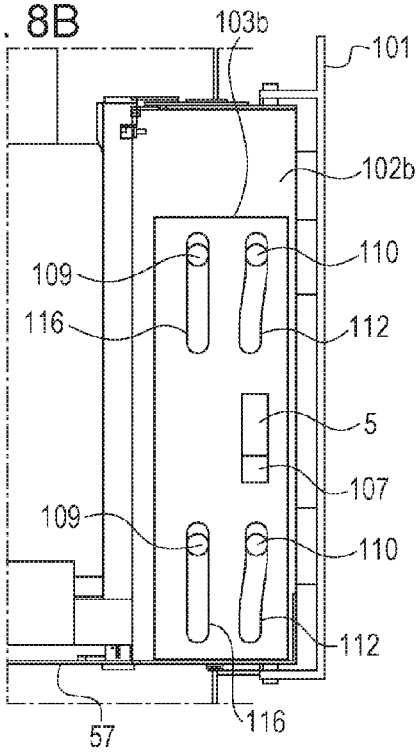
FIG. 8B is a cross-sectional view of the external member setting for LTR size in the first embodiment.
Figure 8C:
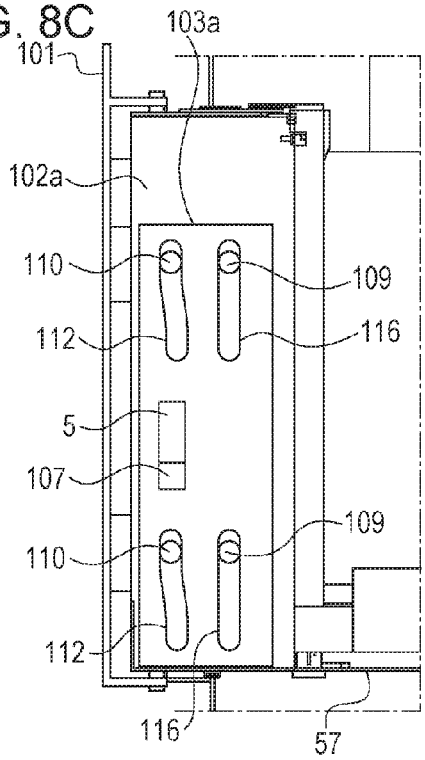
FIG. 8C is a cross-sectional view of the external member setting for A4 size in the first embodiment.
Figure 8D:
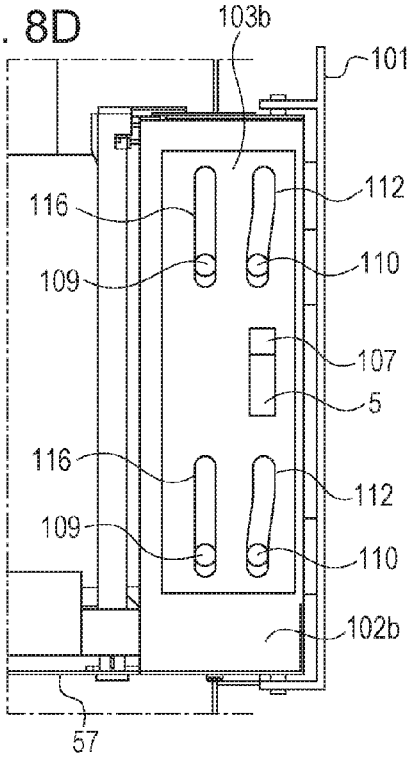
FIG. 8D is a cross-sectional view of the external member setting for A4 size in the first embodiment.

FIGS. 8A to 8D are diagrams illustrating the operation of the external casing plate 101, the positioning members 102*a* and 102*b* (see FIGS. 7A and 7B), and the vertically sliding members 103*a* and 103*b*. FIGS. 8A and 8B illustrates a case in which the sheets S stacked on the intermediate plate 58 in the cassette 52 is of LTR size. FIGS. 8C and 8D illustrates a case in which the sheets S stacked on the intermediate plate 58 in the cassette 52 is of A4 size. FIGS. 8A and 8C are diagrams of the vertically sliding member 103*a* viewed from the left in FIG. 4, and FIGS. 8B and 8D are diagrams of the vertically sliding member 103*b* viewed from the right in FIG. 4.

The vertically sliding members 103*a* and 103*b* shown in FIG. 4 and FIGS. 8A to 8D each have slits 116, which are through-holes linearly extending in the longitudinal direction, in each of which a shaft 109 projecting from the casing 57 of the cassette 52 (see FIG. 4) is slidably disposed. As shown in FIGS. 7A and 7B, the vertically sliding members 103*a* and 103*b* are respectively moved in the directions of arrows D and E (in the vertical direction) in FIG. 7A as the shafts 109 slide in the slits 116 relative to the casing 57 of the cassette 52.

The vertically sliding members 103*a* and 103*b* (see FIGS. 7A and 7B) each have the two upper and lower slits 112 (see FIGS. 8A to 8D) next to the linear slits 116. Shafts 110 each projecting from the positioning members 102*a* and 102*b* are slidably disposed in the slits 112. The slits 112 are through-holes through which the shafts 110 are slidable passed. The slits 112 are cam grooves having right and left level differences and extending in the longitudinal direction, as shown in FIGS. 8A to 8D.

The upper and lower portions of the individual slits 112 of this embodiment are disposed at positions 3 mm shifted in the horizontal direction (in the lateral direction in FIGS. 8A to 8D).

This allows the pair of upper and lower shafts 110 secured to the external casing plate 101 to slide in the pair of upper and lower slits 112 formed of cam grooves in the vertically sliding members 103*a* and 103*b*. This changes the interval between the external casing plate 101 and the vertically sliding member 103*a* and the interval between the external casing plate 101 and the vertically sliding member 103*b*. In other words, the external casing plate 101 for LTR size (see FIGS. 8A and 8B) is separated 3 mm away from the vertically sliding members 103*a* and 103*b* more than that for A4 size (see FIGS. 8C and 8D).

For example, when the user wants to stack the sheets S of A4 size on the intermediate plate 58 in the cassette 52, the user moves the operating lever 105 in the direction of arrow X in FIG. 7A from the state of setting for LTR size in FIG. 7A. This causes the shaft 106 and the rotation member 107 (FIG. 7A) to rotate together about the rotation shaft 8*a* in the direction of arrow R in FIG. 7A together with the movement of the operating lever 105 in the direction of arrow X in FIG. 7A.

As shown in FIGS. 7A and 7B and FIGS. 8A to 8D, the both ends of the rhomboid rotation member 107 in the longitudinal direction are slidably disposed in the slits 5 of the vertically sliding members 103*a* and 103*b*, so that the rotation member 107 and the vertically sliding members 103*a* and 103*b* are engaged with each other. Accordingly, when the rotation member 107 rotates about the rotation shaft 8*a* in the direction of arrow R in FIG. 7A, the vertically sliding members 103*a* and 103*b* respectively move in the directions of arrows D and E in FIG. 7A together with the rotation.

FIG. 7B and FIGS. 8C and 8D illustrate the state of setting for A4 size. As shown in FIGS. 7A and 7B and FIGS. 8A to 8D, the vertically sliding member 103*b* rises from the lowest position shown in FIG. 7A and FIG. 8B to the highest position shown in FIG. 7B and FIG. 8D. At that time, the shafts 110 (see FIGS. 8A to 8D) slides in the slits 112 formed of cam grooves in the vertically sliding member 103*b* from above (see FIG. 8B) to below (see FIG. 8D) along the slits 112.

In contrast, the vertically sliding member 103*a* falls from the highest position shown in FIG. 7A and FIG. 8A to the lowest position shown in FIG. 7B and FIG. 8B. At that time, the shafts 110 (see FIGS. 8A and 8B) slide in the slits 112 formed of cam grooves in the vertically sliding member 103*a* from below (see FIG. 8A) to above (see FIG. 8C) along the slits 112.

This causes the positioning member 102*b* having the shafts 110 and the external casing plate 101 secured to the positioning member 102*b* to be moved toward the casing 57 of the cassette 52 by 3 mm as shown in FIGS. 8C and 8D and FIG. 9B.

FIGS. 9A and 9B are plan views of the cassette 52 illustrating how the laterally sliding member 108 and the non-reference-side regulating plate 104 shown in FIGS. 7A and 7B move together with the movement of the operating lever 105. FIG. 9A illustrates a case in which the sheets S stacked on the intermediate plate 58 in the cassette 52 is of LTR size. FIG. 9B illustrates a case in which the sheets S stacked on the intermediate plate 58 in the cassette 52 is of A4 size.

As shown in FIGS. 9A and 9B, the laterally sliding member 108 includes ribs 114, which engage with protrusions 115 disposed on the non-reference-side regulating plate 104. The ribs 114 of the laterally sliding member 108 each have a slope 114*a* that is 6 mm higher at the left than at the right in FIGS. 9A and 9B.

When the user wants to stack the sheets S of A4 size on the intermediate plate 58 in the cassette 52, the user moves the operating lever 105 in the direction of arrow X in FIG. 9A. This causes the laterally sliding member 108 engaged with the shaft 106 of the operating lever 105 to move in the direction of arrow X in FIG. 9A together with the operating lever 105.

The protrusions 115 on the non-reference-side regulating plate 104 slide along the slopes 114*a* of the ribs 114 provided on the laterally sliding member 108 moving in the direction of arrow X in FIG. 9A. This causes the non-reference-side regulating plate 104 to move by 6 mm along the slopes 114*a* of the ribs 114 provided on the laterally sliding member 108 toward the casing 57 of the cassette 52 in the direction of arrow Z in FIG. 9B, as shown in FIG. 9B.

In other words, the non-reference-side regulating plate 104 serving as a regulating member moves by 6 mm toward the casing 57 of the cassette 52. The positioning members 102*a* and 102*b* move toward the casing 57 of the cassette 52 by 3 mm. Accordingly, in this embodiment, the amount of movement of the non-reference-side regulating plate 104 serving as a regulating member is set to twice (=mm/3 mm) the amount of movement of the positioning members 102*a* and 102*b*.

When the user stacks the sheets S of A4 size on the intermediate plate 58 in the cassette 52 and inserts the cassette 52 into the large-volume feeding deck 51 main body in the direction of arrow A in FIG. 2 in the state of setting for A4 size shown in FIG. 9B, the cassette 52 is drawn into a predetermined position in the large-volume feeding deck 51 main body by the drawing mechanism 71 (FIGS. 6A and 6B), and the positioning members 102*a* and 102*b* (FIGS. 9A and 9B) come into contact with the frame 51*a* of the large-volume feeding deck 51.

At that time, the positions of the positioning members 102*a* and 102*b* relative to the casing 57 of the cassette 52 are shifted by 3 mm in the direction nearer to the casing 57 of the cassette 52 indicated by the arrow Z in FIG. 9B from the positions for LTR size shown in FIG. 9A.

The position of the reference-side regulating plate 111 secured to the casing 57 of the cassette 52 (see FIG. 4 and FIG. 5) relative to the large-volume feeding deck 51 main body is therefore located 3 mm ahead of that for LTR size (see FIG. 9A) (in the opposite direction from arrow Z in FIG. 9B).

In contrast, the position of the non-reference-side regulating plate 104 relative to the casing 57 of the cassette 52 for A4 size shown in FIG. 9B is closer to the rear (in the direction of the arrow Z in FIG. 9B) by 6 mm than the position for LTR size shown in FIG. 9A.

The position of the non-reference-side regulating plate 104 relative to the large-volume feeding deck 51 main body is therefore closer to the rear (in the direction of arrow Z in FIG. 9B) by 3 mm than the position for LTR size shown in FIG. 9A.

Thus, the position of the non-reference-side regulating plate 104 relative to the large-volume feeding deck 51 main body can be adjusted on the basis of the difference between the width (about 216 mm) of the sheets S of LTR size and the width (210 mm) of the sheets S of A4 size (about 6 mm=about 216 mm−210 mm) to determine the center of the sheets S (guide center).

The external casing plate 101 is secured to the positioning members 102*a* and 102*b* and can be moved together with the positioning members 102*a* and 102*b*. This prevents the external casing plate 101 from positional shift from other external parts of the large-volume feeding deck 51 even if the size of the sheets S stacked on the intermediate plate 58 in the cassette 52 is changed from LTR size (FIG. 9A) to A4 size (FIG. 9B).

This allows sheets S of different sizes to be stacked on the intermediate plate 58 in the cassette 52 without moving the reference-side regulating plate 111 (FIG. 4 and FIG. 5) relative to the casing 57 of the cassette 52.

This ensures sufficient strength of the reference-side regulating plate 111, and even if the cassette 52 in which a large volume of sheets S is stacked on the intermediate plate 58 is moved with strength, the reference-side regulating plate 111 is not bent, allowing the sheets S to be accurately positioned.

Second Embodiment

Referring next to FIG. 10 to FIGS. 15A to 15C, the configuration of an image forming apparatus including a sheet feeding apparatus according to a second embodiment of the present invention will be described. The same components as those in the first embodiment are given the same reference signs or the same component names with different reference sign, and their descriptions will be omitted In this embodiment, an example of a cassette 52 to be inserted into a large-volume feeding deck 51 main body serving as a sheet feeding apparatus, shown in FIG. 10, connected to the lower part of an image forming apparatus 1 main body, which is a laser beam printer, as in the first embodiment, will be described. Main components, such the an image forming unit 2 and the large-volume feeding deck 51, are the same as those of the first embodiment, and their description will be omitted.

Figure 11:
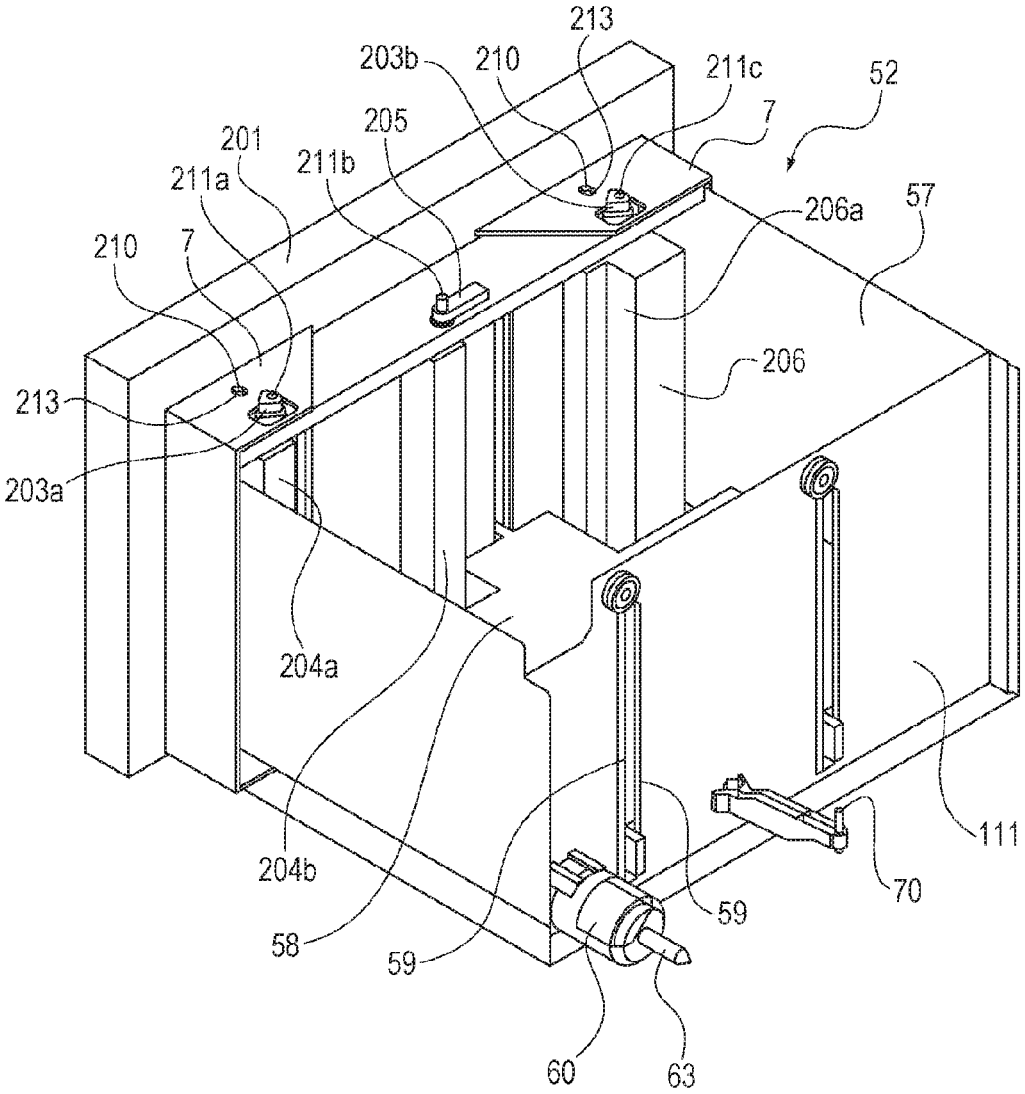
FIG. 11 is a perspective view of the cassette unit which can be inserted into and extracted from the sheet feeding apparatus main body in the second embodiment.
Figure 12:
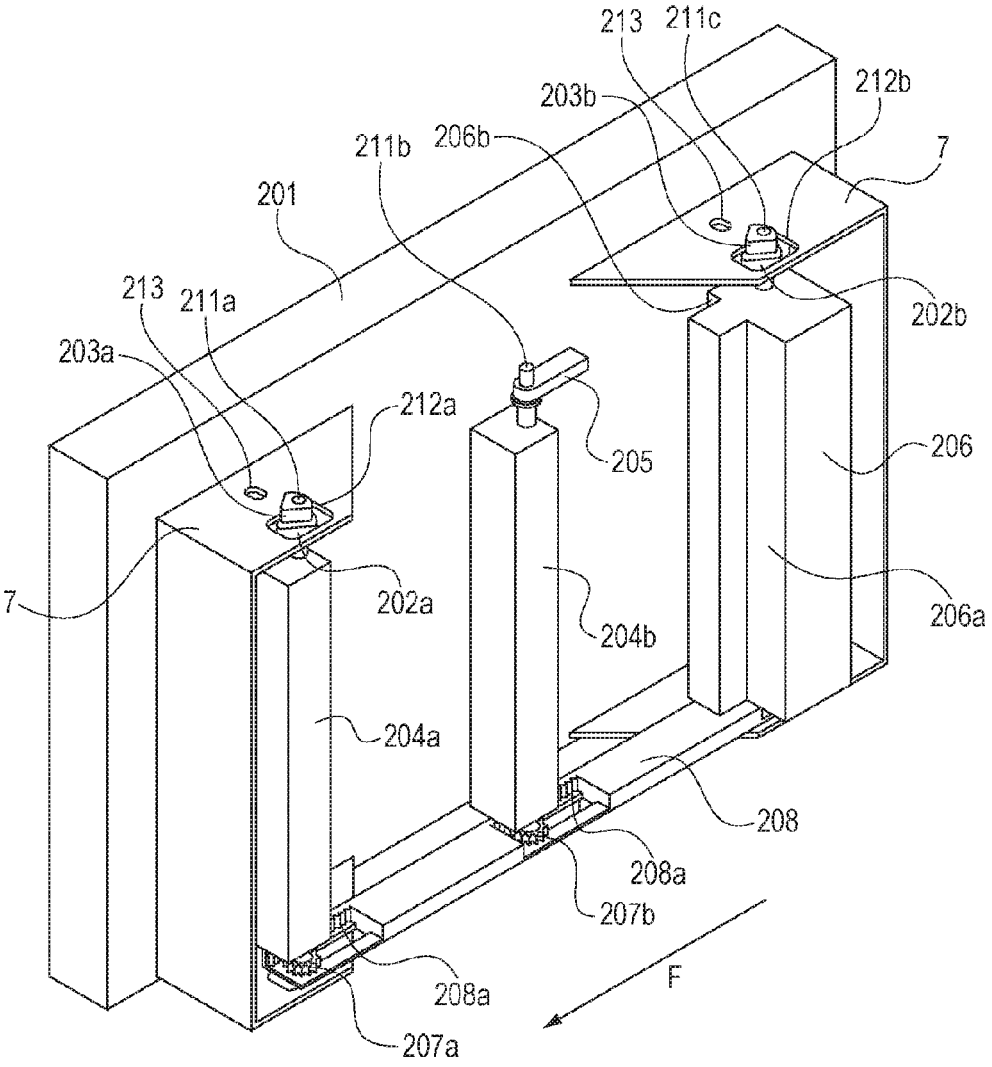
FIG. 12 is a perspective view of connecting members disposed on an external member in the second embodiment.

FIG. 11 is a perspective view of the cassette 52 which can be inserted into and extracted from the large-volume feeding deck 51 serving as the sheet feeding apparatus according to this embodiment and in which sheets S are to be stacked on an intermediate plate 58 that can be moved up and down. FIG. 12 is a perspective view of connecting members disposed on an external casing plate 201 according to this embodiment.

As shown in FIG. 12, the cassette 52 includes non-reference-side regulating members 204*a* and 204*b* and a rear-end regulating member 206 serving as regulating members that regulate the end of at least one side of the sheets S stacked on the intermediate plate 58 in the cassette 52.

The cassette 52 further includes an external casing plate 201 serving as an external member for covering the front surface of the large-volume feeding deck 51. The external casing plate 201 is movable relative to the cassette 52. The cassette 52 further includes cassette positioning members 203*a* and 203*b* serving as positioning members for positioning the cassette 52 relative to the large-volume feeding deck 51.

The cassette 52 further includes an operating lever 205 on one side of the periphery of the cassette 52.

The cassette 52 further includes connecting members. The connecting members connect the operating lever 205, the non-reference-side regulating members 204*a* and 204*b* and the rear-end regulating member 206 serving as regulating members, the external casing plate 201 serving as an external member, and the cassette positioning members 203*a* and 203*b* serving as positioning members together.

The connecting members include a rack 208 and gears 207*a* to 207*c* (the gear 207*c* is not shown in FIG. 12) that engage with a teeth portions 208*a* of the rack 208. The connecting members further include shafts 211*a* to 211*c* to which the gears 207*a* to 207*c* are respectively secured and external-casing positioning members 202*a* and 202*b* which are respectively secured to the shafts 211*a* and 211*c*.

The non-reference-side regulating members 204*a* and 204*b* and the rear-end regulating member 206 serving as regulating members are respectively rotatable about the shafts 211*a* to 211*c* in the cassette 52. The ends of sheets S of different sizes (sheet edges) can be regulated by rotating the non-reference-side regulating members 204*a* and 204*b* and the rear-end regulating member 206.

The regulating members of this embodiment include the non-reference-side regulating members 204*a* and 204*b* serving as side regulating members for regulating the widthwise position of the sheets S stacked on the intermediate plate 58 in the cassette 52 by coming into contact with the side of the sheets S parallel to the sheet feeding direction. The regulating members further include the rear-end regulating member 206 for regulating the position of the sheets S in the feeding direction by coming into contact with the rear end of the sheets S in the sheet feeding direction.

When the user rotates the operating lever 205 about the shaft 211*b*, the shaft 211*b* to which the operating lever 205 is secured rotates therewith, and the non-reference-side regulating member 204*b* and the gear 207*b* secured to the shaft 211*b* rotate together. The gear 207*b* engages with the teeth portion 208*a* of the rack 208, and the rack 208 slides in the direction of arrow F in FIG. 12.

Since the rack 208 slides in the direction of arrow F in FIG. 12, the shafts 211*a* and 211*c* to which the gears 207*a* and 207*c* are secured by the engagement of the teeth portions 208*a* of the rack 208 with the gears 207*a* and 207*c* rotate. This causes the non-reference-side regulating member 204*a*, the rear-end regulating member 206, the external-casing positioning members 202*a* and 202*b*, and the cassette positioning members 203*a* and 203*b* respectively secured to the shafts 211*a* and 211*c* to rotate together.

Since the user rotates the operating lever 205 about the shaft 211*b*, the rear-end regulating member 206 and the non-reference-side regulating members 204*a* and 204*b* are operatively connected to be positioned at predetermined positions.

The non-reference-side regulating members 204*a* and 204*b* and the rear-end regulating member 206, the external casing plate 201, and the cassette positioning members 203*a* and 203*b* are movable relative to the cassette 52.

The user rotates the operating lever 205 about the shaft 211*b* to set to a predetermined sheet size. This causes the connecting members including the rack 208, the gears 207*a* to 207*c*, and the external-casing positioning members 202*a* and 202*b* to move cooperatively. This causes the non-reference-side regulating members 204*a* and 204*b* and the rear-end regulating member 206, the external casing plate 201, and the cassette positioning members 203*a* and 203*b* to be operatively connected to be positioned at predetermined positions.

As shown in FIGS. 13A to 13C to FIGS. 15A to 15C, the non-reference-side regulating members 204*a* and 204*b* and the rear-end regulating member 206, the external casing plate 201, and the cassette positioning members 203*a* and 203*b* are operatively connected and are moved in the direction in which the cassette 52 is inserted into the large-volume feeding deck 51 (in the vertical direction in FIGS. 13A to 13C to FIGS. 15A to 15C).

Figure 10:
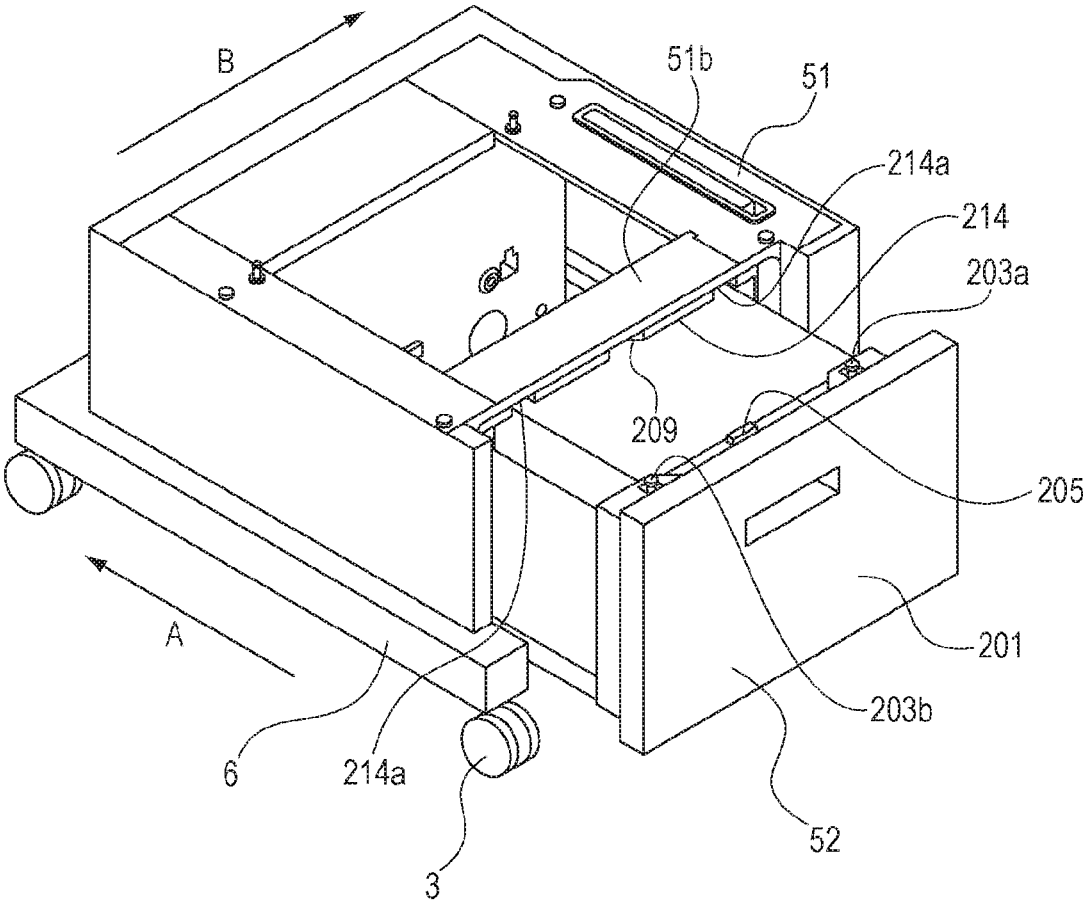
FIG. 10 is a perspective view of a cassette unit drawn from the sheet feeding apparatus main body in a second embodiment of the present invention.

Referring to FIG. 11 and FIG. 12, the non-reference-side regulating members 204*a* and 204*b* regulate the front end of the sheets S stacked on the intermediate plate 58 in the cassette 52 (see FIG. 11) in the direction in which the cassette 52 is inserted into the large-volume feeding deck 51 main body (see FIG. 10) (in the direction of arrow A in FIG. 10).

The rear-end regulating member 206 regulates the upstream end of the sheets S stacked on the intermediate plate 58 in the cassette 52 in the feeding direction (the direction of arrow B in FIG. 10).

As shown in FIG. 12, the non-reference-side regulating members 204*a* and 204*b* and the rear-end regulating member 206 are secured to their respective shafts 211*a* to 211*c*. The non-reference-side regulating members 204*a* and 204*b* and the rear-end regulating member 206 are supported by the casing 57 of the cassette 52 in such a manner that they can rotate about their respective shafts 211*a* to 211*c*.

The gears 207*a* to 207*c* which engage with the teeth portions 208*a* of the rack 208 are respectively secured, below the non-reference-side regulating members 204*a* and 204*b* and the rear-end regulating member 206, to the shafts 211*a* to 211*c*. FIG. 12 does not illustrate the gear 207*c* secured, below the rear-end regulating member 206, on the shaft 211*c* and the teeth portion 208*a* of the rack 208, with which the gear 207*c* engages.

The teeth portions 208*a* disposed on the rack 208 respectively engage with the gears 207*a* to 207*c* secured to the shafts 211*a* to 211*c* below the non-reference-side regulating members 204*a* and 204*b* and the rear-end regulating member 206. This allows the non-reference-side regulating members 204*a* and 204*b* and the rear-end regulating member 206 respectively rotate cooperatively about the shafts 211*a* to 211*c* via the rack 208 serving as a connecting member.

As shown in FIG. 12, the cassette positioning member 203*a* and the external-casing positioning member 202*a* are secured to the shaft 211*a* to which the non-reference-side regulating member 204*a* is secured, and the cassette positioning member 203*b* and the external-casing positioning member 202*b* are secured to the shaft 211*c* to which the rear-end regulating member 206 is secured. A support frame disposed on the external casing plate 201 has substantially rectangular through-holes 212*a* and 212*b*.

Figure 14A:
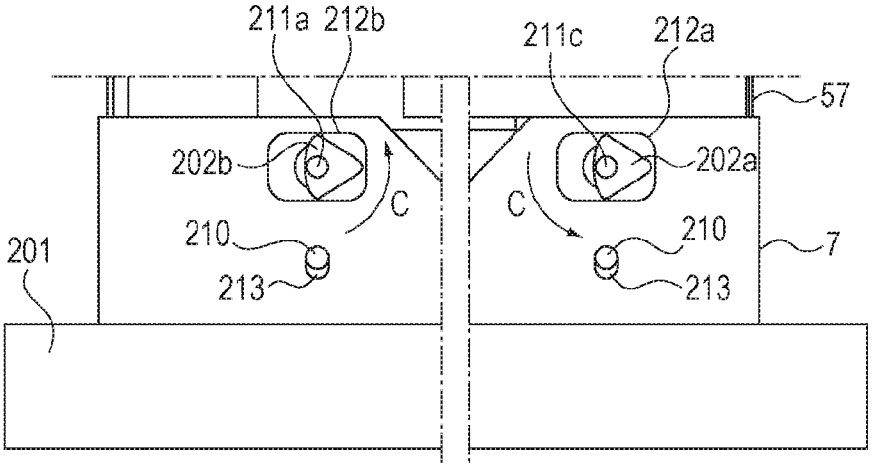
FIG. 14A is a cross-sectional view of external members set for LTR size in the second embodiment.
Figure 14B:
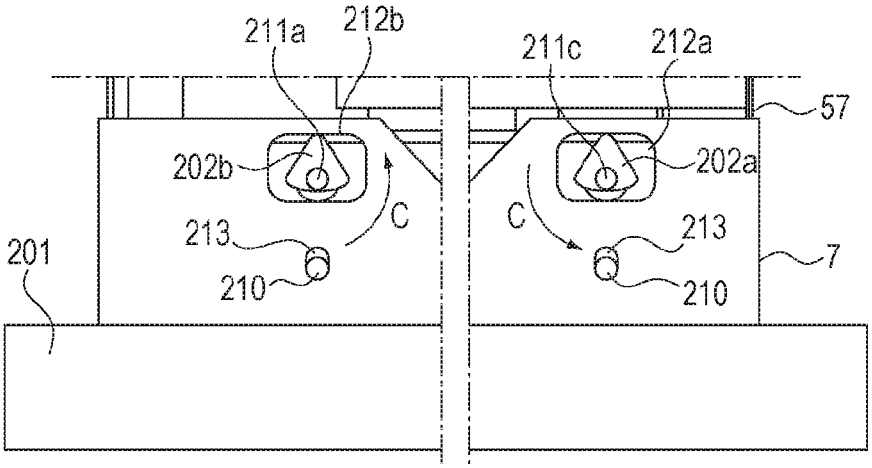
FIG. 14B is a cross-sectional view of the external members set for A4 size in the second embodiment.
Figure 14C:
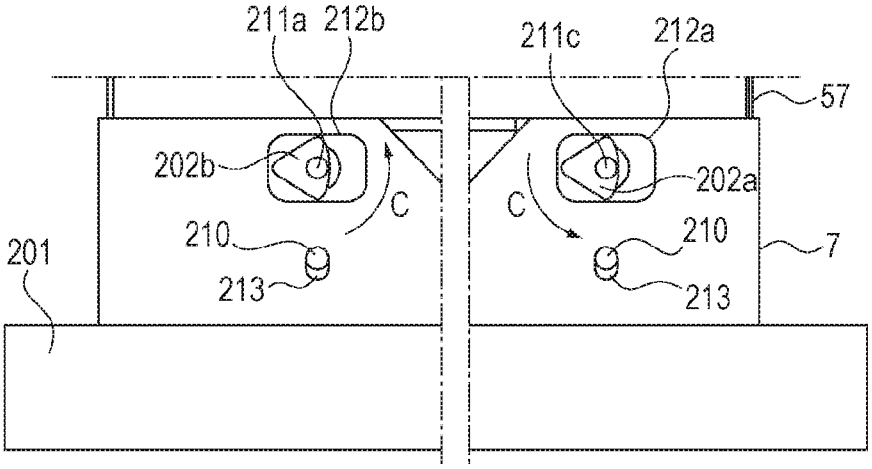
FIG. 14C is a cross-sectional view of the external members set for LGL size in the second embodiment.

As shown in FIGS. 14A to 14C, substantially sector-shaped external-casing positioning members 202*a* and 202*b* are respectively rotatably disposed in the substantially rectangular through-holes 212*a* and 212*b* in such a manner that the peripheral surfaces of the major-axis portions or the minor-axis portions can slide on the wall surfaces. The external-casing positioning members 202*a* and 202*b* respectively rotate about the shafts 211*a* and 211*c*, so that the peripheral surfaces of the major-axis portions or the minor-axis portions of the substantially sector-shaped external-casing positioning members 202*a* and 202*b* slide along the inner peripheries of the substantially rectangular through-holes 212*a* and 212*b*.

As shown in FIG. 12, the cassette positioning members 203*a* and 203*b* are respectively secured to the shafts 211*a* and 211*c* at positions on the external-casing positioning members 202*a* and 202*b* at which the cassette positioning members 203*a* and 203*b* do not interfere with the inner peripheries of the holes 212*a* and 212*b*. The cassette positioning members 203*a* and 203*b* are disposed in U-shaped slits 214*a* in a frame positioning member 214 disposed on the top of the cassette 52 shown in FIGS. 15A to 15C.

The cassette positioning members 203*a* and 203*b* respectively rotate about the shafts 211*a* and 211*c*, so that the outer peripheral surfaces of the major-axis portions or the minor-axis portions of the substantially sector-shaped cassette positioning members 203*a* and 203*b* slide on the wall surfaces of the U-shaped slits 214*a*.

Figure 15A:
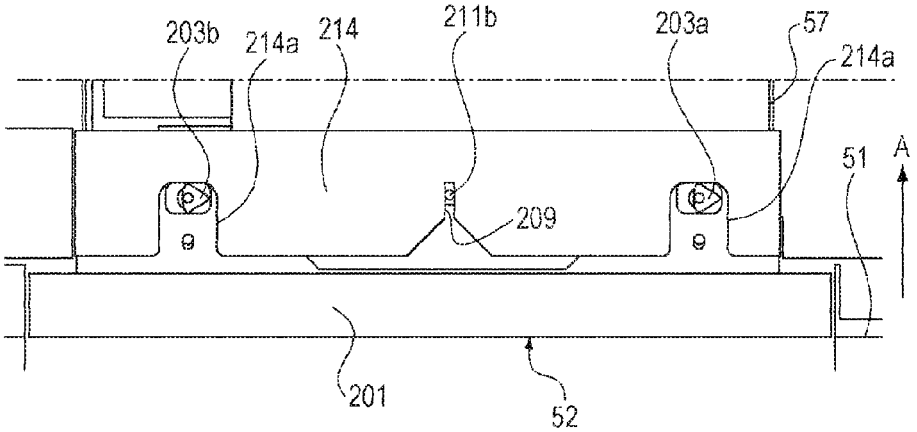
FIG. 15A is a cross-sectional view of positioning members set for LTR size in the second embodiment.
Figure 15B:
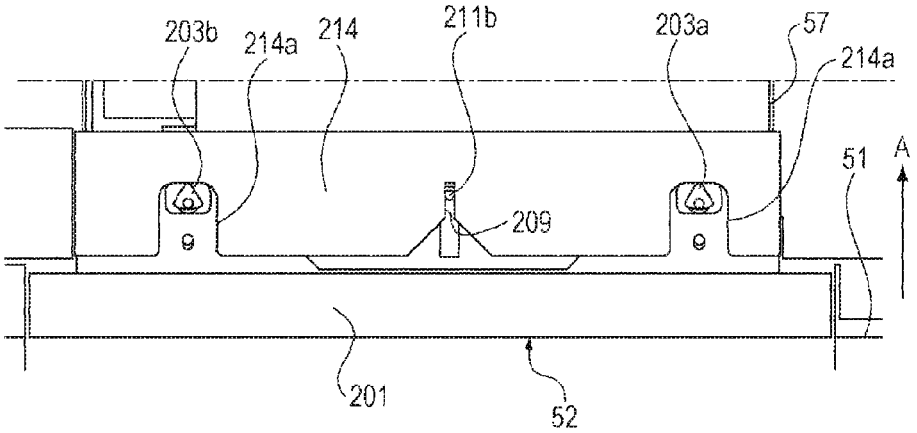
FIG. 15B is a cross-sectional view of the positioning members set for A4 size in the second embodiment.
Figure 15C:
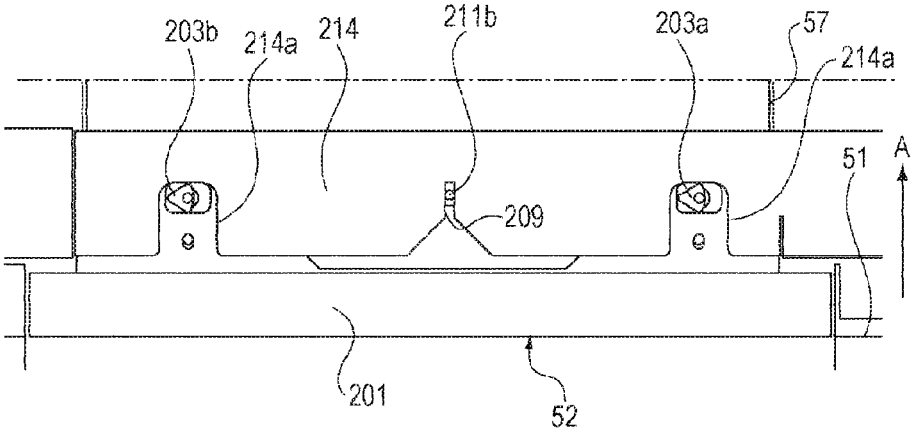
FIG. 15C is a cross-sectional view of the positioning members set for LGL size in the second embodiment.

As shown in FIGS. 15A to 15C, the cassette positioning members 203*a* and 203*b* respectively rotate about the shafts 211*a* and 211*c*. This allows the cassette 52 to be positioned relative to the large-volume feeding deck 51 main body in the inserting direction (in the direction of arrow A in FIGS. 15A to 15C).

Sheet-Size Changing Operation

Referring next to FIG. 10 to FIGS. 15A to 15C, a user operation for changing the size of the sheets S stacked on the intermediate plate 58 in the cassette 52 by operating the operating lever 205 will be described. In this embodiment, three kinds of sheets S, that is, LTR size, A4 size, and LGL (Legal) size (215.9 mm×355.6 mm), can be stacked on the intermediate plate 58 in the cassette 52. The following is an operation for changing the setting for LTR size (see FIG. 13A, FIG. 14A, and FIG. 15A) to the setting for A4 size (see FIG. 13B, FIG. 14B, and FIG. 15B).

Figure 13A:
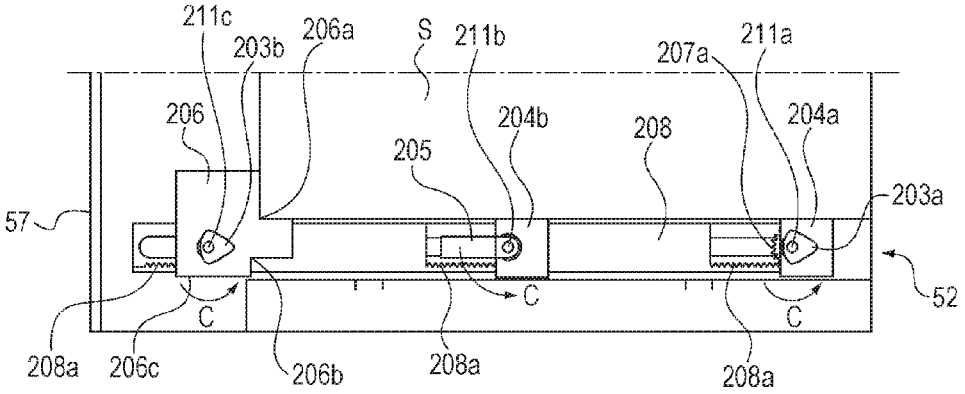
FIG. 13A is a cross-sectional view of non-reference-side side regulating members set for LTR size in the second embodiment.
Figure 13B:
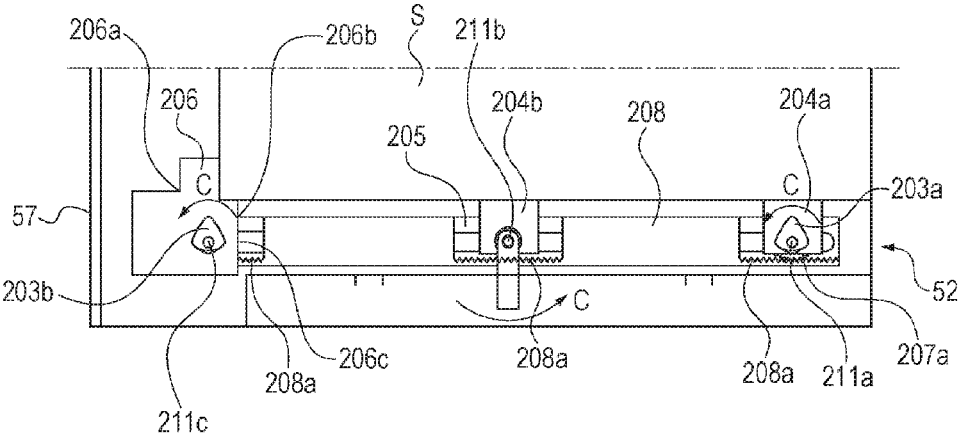
FIG. 13B is a cross-sectional view of the non-reference-side side regulating members set for A4 size in the second embodiment.
Figure 13C:
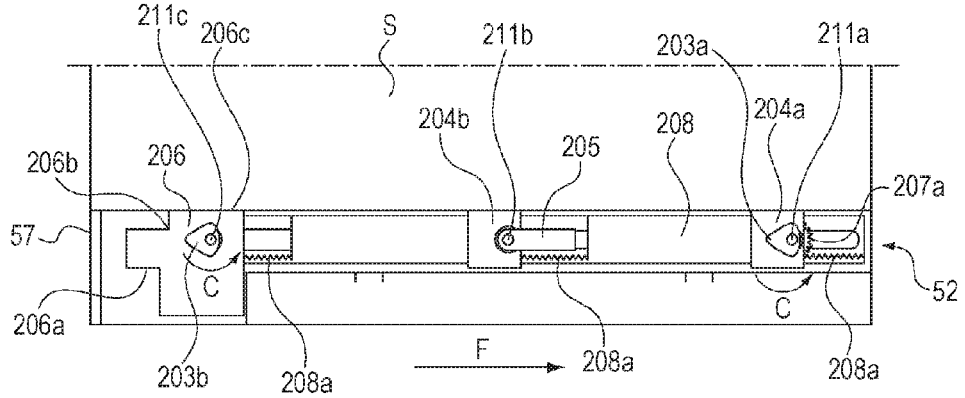
FIG. 13C is a cross-sectional view of the non-reference-side side regulating members set for LGL size in the second embodiment.

As shown in FIG. 11 and FIG. 12, the shaft 211*b* is provided with the operating lever 205 that the user operates when changing the size of the sheets S stacked on the intermediate plate 58 in the cassette 52. FIG. 13A illustrates a case in which the sheets S to be stacked on the intermediate plate 58 in the cassette 52 is of LTR size. FIG. 13B illustrates a case in which the sheets S to be stacked on the intermediate plate 58 in the cassette 52 is of A4 size. FIG. 13C illustrates a case in which the sheets S to be stacked on the intermediate plate 58 in the cassette 52 is of LGL size.

When the user changes the size of the sheets S stacked on the intermediate plate 58 in the cassette 52 from the setting for LTR size (see FIG. 13A) to the setting for A4 size (see FIG. 13B), the user rotates the operating lever 205 by 90 degrees about the shaft 211*b* in the direction of arrow C in FIG. 13A from the setting for LTR size (see FIG. 13A). This brings the setting to the setting for A4 size shown in FIG. 13B.

At that time, the shaft 211*b* to which the operating lever 205 (see FIG. 12) is secured, the non-reference-side regulating member 204*b* secured to the shaft 211*b*, and the gear 207*b* secured to the shaft 211*b* rotate together about the shaft 211*b*.

When the gear 207*b* rotates about the shaft 211*b* together with the rotation of the operating lever 205, the rack 208 having the teeth portion 208*a* at a position at which the teeth portion 208*a* can engage with the gear 207*b* slides in the direction of arrow F in FIG. 12.

Since the rack 208 slides in the direction of arrow F in FIG. 12, the shafts 211*a* and 211*c* to which the gears 207*a* and 207*c*, which respectively engage with the teeth portions 208*a* of the rack 208, are secured rotate in the direction of arrow C in FIG. 13A.

This causes the external-casing positioning members 202*a* and 202*b* and the cassette positioning members 203*a* and 203*b*, which are respectively secured to the shafts 211*a* and 211*c* (see FIG. 12), to rotate 90 degrees about the shafts 211*a* and 211*c* from the setting for LTR (see FIG. 13A) in the direction of arrow C in FIG. 13A. This brings the setting for LTR size to the setting for A4 size shown in FIG. 13B. The gear 207*c* is not shown in FIG. 12.

The non-reference-side regulating members 204*a* and 204*b* and the rear-end regulating member 206 (see FIG. 12) respectively rotate from the setting for LTR size (see FIG. 13A) 90 degrees about the shafts 211*a* to 211*c* in the direction of arrow C in FIG. 13A. At that time, the surfaces of the non-reference-side regulating members 204*a* and 204*b* in contact with the side edge of the sheets S are brought closer to the rear of the cassette 52 main body (above in FIG. 13B) by about 6 mm from the contact surfaces for the setting for LTR size (see FIG. 13A), as shown in FIG. 13B.

The surface of the rear-end regulating member 206 in contact with the rear corner of the sheets S switches from a corner regulating portion 206*a* for regulating the rear corner of the sheets S of LTR size (see FIG. 13A) to a corner regulating portion 206*b* for regulating the rear corner of the sheets S of A4 size (see FIG. 13B).

This brings the rear end of the sheets S regulated by the rear-end regulating member 206 about 17.6 mm upstream (the left in FIGS. 13A and 13B) in the sheets S feeding direction (the lateral direction in FIGS. 13A and 13B) from the rear end for LTR size (see FIG. 13A).

Thus, when the sheets S of A4 size are to be stacked on the intermediate plate 58 in the cassette 52 in the setting for A4 size (see FIG. 13B), the rear end and the side edges of the sheets S of A4 size can be regulated by the non-reference-side regulating members 204*a* and 204*b* and the rear-end regulating member 206.

FIGS. 14A and 14B are plan views of the external-casing positioning members 202*a* and 202*b* and the external casing plate 201 illustrating a user operation for rotating the operating lever 205 (see FIG. 13A) 90 degrees about the shaft 211*b* from the setting for LTR size (see FIG. 13A) in the direction of arrow C in FIG. 13A.

FIG. 14A illustrates a case in which the sheets S to be stacked on the intermediate plate 58 in the cassette 52 is of LTR size. FIG. 14B illustrates a case in which the sheets S to be stacked on the intermediate plate 58 in the cassette 52 is of A4 size. FIG. 14C illustrates a case in which the sheets S to be stacked on the intermediate plate 58 in the cassette 52 is of LGL size.

As shown in FIGS. 14A to 14C, the support frame 7 of the external casing plate 201 has elongated holes 213 in each of which a pin 210 projecting from the casing 57 of the cassette 52 is slidably disposed. As shown in FIG. 14A, an operation for positioning the external casing plate 201 for LTR size is as follows. The minor-axis portions of the substantially sector-shaped external-casing positioning members 202*a* and 202*b* come into contact with the wall surfaces of sides of the substantially rectangular holes 212*a* and 212*b* (the lower sides in FIG. 14A) disposed in the support frame 7 of the external casing plate 201.

The pins 210 projecting from the casing 57 of the cassette 52 come into contact with ends of the wall surfaces (the upper ends in FIG. 14A) in the longitudinal direction (the vertical direction in FIG. 14A) of the elongated holes 213 disposed in the support frame 7 of the external casing plate 201. This allows the support frame 7 of the external casing plate 201 to be held and secured with the external-casing positioning members 202*a* and 202*b* and the pins 210, and the external casing plate 201 is positioned.

The operating lever 205 (see FIG. 13A) is rotated 90 degrees about the shaft 211*b* from the state of setting for LTR size (see FIG. 13A) in the direction of arrow C in FIG. 13A. This causes the setting for the sheets S stacked on the intermediate plate 58 in cassette 52 to be changed from the setting for LTR size (see FIG. 14A) to the setting for A4 size (see FIG. 14B). This causes the external-casing positioning members 202*a* and 202*b* to be respectively rotated 90 degrees about the shafts 211*a* and 211*c* in the direction of arrow C in FIG. 14A.

The substantially sector-shaped external-casing positioning members 202*a* and 202*b* respectively rotate 90 degrees about the shafts 211*a* and 211*c* in the direction of arrow C in FIG. 14B while sliding on the wall surfaces of the substantially rectangular holes 212*a* and 212*b* in the support frame 7 of the external casing plate 201, as shown in FIG. 14B.

This brings the major-axis portions of the substantially sector-shaped external-casing positioning members 202*a* and 202*b* into contact with the wall surfaces of other sides (the upper sides in FIG. 14B) of the substantially rectangular holes 212*a* and 212*b* disposed in the support frame 7 of the external casing plate 201. The pins 210 projecting from the casing 57 of the cassette 52 slide in the elongated holes 213 disposed in the support frame 7 of the external casing plate 201 come into contact with the other ends (the lower ends in FIG. 14B) in the longitudinal direction (the vertical direction in FIG. 14B) of the wall surfaces of the elongated holes 213.

This allows the support frame 7 of the external casing plate 201 to be held and secured with the external-casing positioning members 202*a* and 202*b* and the pins 210. Thus, the external casing plate 201 is positioned closer to the rear of cassette 52 main body (the casing 57) (upward in FIG. 14B) by about 3 mm.

Referring next to FIG. 10 and FIGS. 15A to 15C, an operation for positioning the cassette 52 to be inserted into the large-volume feeding deck 51 will be described. As shown in FIG. 10, the frame positioning member 214 having the U-shaped slits 214*a* is disposed under the top plate 51*b* of the large-volume feeding deck 51.

When the cassette 52 is inserted into the large-volume feeding deck 51, the outer peripheral surfaces of the major-axis portions and the minor-axis portions of the cassette positioning members 203*a* and 203*b* of the cassette 52 slide on the inner wall surfaces of the U-shaped slits 214*a*. The frame positioning member 214 further includes a Y-shaped slit 209.

As shown in FIG. 10, the cassette 52 is inserted into the large-volume feeding deck 51 in the direction of arrow A in FIG. 10. At that time, the shaft 211*b* (see FIG. 11 and FIG. 12) disposed at the cassette 52 is guided by the Y-shaped slit 209 disposed in the frame positioning member 214 (see FIGS. 15A to 15C). This allows the position of the cassette 52 in the lateral direction (the lateral direction in FIGS. 15A to 15C) relative to the large-volume feeding deck 51 to be determined.

FIG. 15A illustrates a case in which the sheets S to be stacked on the intermediate plate 58 in the cassette 52 is of LTR size. FIG. 15B illustrates a case in which the sheets S to be stacked on the intermediate plate 58 in the cassette 52 is of A4 size. FIG. 15C illustrates a case in which the sheets S to be stacked on the intermediate plate 58 in the cassette 52 is of LGL size.

When the cassette 52 is inserted into a predetermined position in the large-volume feeding deck 51, the cassette 52 is drawn toward the rear (in the direction of arrow A in FIG. 10) in the large-volume feeding deck 51 by the drawing mechanism 71 (see FIGS. 6A and 6B). As shown in FIGS. 15A to 15C, this brings the substantially sector-shaped cassette positioning members 203*a* and 203*b* of the cassette 52 into contact with the wall surfaces of the U-shaped slits 214*a* in the frame positioning member 214 of the large-volume feeding deck 51. This allows the position of the cassette 52 in the rearward direction (the direction of arrow A in FIG. 10) relative to the large-volume feeding deck 51 to be determined.

For LTR size (see FIG. 15A), the outer peripheral surfaces of the minor-axis portions of the substantially sector-shaped cassette positioning members 203*a* and 203*b* come into contact with the inner wall surfaces of the U-shaped slits 214*a*. For A4 size (see FIG. 15B), the major-axis portions of the substantially sector-shaped cassette positioning members 203*a* and 203*b* come into contact with the inner wall surfaces of the U-shaped slits 214*a*.

Thus, the positioning for LTR size (FIG. 15A) and the positioning for A4 size (FIG. 15B) are as follows. The positions of the outer peripheral surfaces of the cassette positioning members 203*a* and 203*b* in contact with the inner wall surfaces of the U-shaped slits 214*a* of the frame positioning member 214 differ between the minor-axis portions and the major-axis portions by about 3 mm in the direction of arrow A in FIGS. 15A and 15B.

This causes the position of the casing 57 of the cassette 52 for A4 size (see FIG. 15B) relative to the large-volume feeding deck 51 main body to be shifted by about 3 mm from that for LTR size (see FIG. 15A).

In other words, as shown in FIG. 13A, the non-reference-side regulating members 204*a* and 204*b* and the rear-end regulating member 206 serving as regulating members in this embodiment respectively rotate 90 degrees about the shafts 211*a* to 211*c* in the direction of arrow C in FIG. 13A from the state of setting for LTR size shown in FIG. 13A.

The amount of movement of the contact surface between the side edge of the sheets S and the non-reference-side regulating members 204*a* and 204*b* and the rear-end regulating member 206 from the state of setting for LTR size (see FIG. 13A) to the state of setting for A4 size (see FIG. 13B) is 6 mm.

The amount of movement of the cassette positioning members 203*a* and 203*b* serving as positioning members is 3 mm, which is the difference in length between the minor-axis portions and the major-axis portions, as shown in FIGS. 15A and 15B.

Accordingly, the amount of movement of the contact surface between the side edge of the sheets S and the non-reference-side regulating members 204*a* and 204*b* and the rear-end regulating member 206 (see FIGS. 13A and 13B) is set to twice the amount of movement of the cassette positioning members 203*a* and 203*b* (see FIGS. 15A and 15B) (=6 mm/3 mm).

The external casing plate 201 moves relative to the casing 57 of the cassette 52 by about 3 mm together with the external-casing positioning members 202*a* and 202*b* toward the rear of the cassette 52 main body (upward in FIG. 14B), as shown in FIG. 14B. This prevents the external casing plate 201 of the cassette 52 from being deviated from the other external parts of the large-volume feeding deck 51 even if the sheet size is changed from LTR size (FIG. 15A) to A4 size (FIG. 15B).

This allows the sheets S of different sizes to be stacked on the intermediate plate 58 without moving the reference-side regulating plate 111 (see FIG. 11) relative to the casing 57 of the cassette 52. This ensures sufficient strength of the reference-side regulating plate 111 and prevents the reference-side regulating plate 111 from being bent even if the cassette 52 in which a large volume of sheets S are stacked on the intermediate plate 58 is moved with strength, allowing accurate positioning of the sheets S.

When the sheet size is to be changed from A4 size (FIG. 13B, FIG. 14B, and FIG. 15B) to LGL size (FIG. 13C, FIG. 14C, and FIG. 15C), the operating lever 205 (FIG. 13B) is rotated 90 degrees about the shaft 211*b* in the direction of arrow C in FIG. 13B from the position for A4 size (FIG. 13B) to the position for LGL size (FIG. 13C).

The rotating operation on the operating lever 205 causes the shaft 211*b* to which the operating lever 205 is secured (FIG. 12) to be rotated. Furthermore, the non-reference-side regulating member 204*b* secured to the shaft 211*b* rotates, and the gear 207*b* secured to the shaft 211*b* rotates about the shaft 211*b*.

When the gear 207*b* rotates together with the operating lever 205, the rack 208 having the teeth portions 208*a* that engage with the gear 207*b* slides in the direction of arrow F in FIG. 13C. This rotates the shafts 211*a* and 211*c* to which the gears 207*a* and 207*c* are secured (FIG. 12), which respectively engage with the teeth portions 208*a* of the rack 208, in the direction of arrow C in FIG. 13C.

This causes the cassette positioning members 203*a* and 203*b* (FIG. 13C) and the external-casing positioning members 202*a* and 202*b* (FIG. 14C), which are respectively secured to the shafts 211*a* and 211*c*, to be respectively rotated 90 degrees from the state of setting for A4 size (FIG. 13B) about the shafts 211*a* and 211*c* in the direction of arrow C in FIG. 13C. The setting state is thus shifted to the state of setting for LGL size (FIG. 13C). The gear 207*c* is not shown in FIG. 12.

The non-reference-side regulating members 204*a* and 204*b* and the rear-end regulating member 206 (FIG. 13C) respectively rotate 90 degrees about the shafts 211*a* to 211*c* in the direction of arrow C in FIG. 13C from the state of setting for A4 size (FIG. 13B). At that time, the contact surface between the non-reference-side regulating members 204*a* and 204*b* and the end of the sheets S is about mm closer to the front (below in FIG. 13C) of the cassette 52 main body relative to that for A4 size (FIG. 13B).

The contact surface between the rear-end regulating member 206 and the end of the sheets S is switched from the corner regulating portion 206*b* that regulates the rear corner of the A4-size sheets S (see FIG. 13B) to a side-edge regulating flat portion 206*c* for regulating the side edge of the LGL-size sheets S (FIG. 13C). This allows the side edge of the LGL-size sheets S to be regulated by the non-reference-side regulating members 204*a* and 204*b* and the rear-end regulating member 206 when the sheets are to be stacked on the intermediate plate 58 in the cassette 52.

As shown in FIG. 13C, the rear-end regulating member 206 for the setting for LGL size is set to be flush with the regulating surfaces of the non-reference-side regulating members 204*a* and 204*b*. The position of the rear end of the LGL-size sheets S stacked on the intermediate plate 58 in the cassette 52 is regulated by contact with the inner wall surface of the casing 57 of the cassette 52.

As shown in FIG. 14C, the substantially sector-shaped external-casing positioning members 202*a* and 202*b* respectively rotate 90 degrees about the shafts 211*a* and 211*c* in the direction of arrow C in FIG. 14C while sliding along the wall surfaces of the substantially rectangular holes 212*a* and 212*b* disposed in the support frame 7 of the external casing plate 201.

This causes the minor-axis portions of the substantially sector-shaped external-casing positioning members 202*a* and 202*b* to come into contact with the wall surfaces of sides (the lower sides in FIG. 14C) of the substantially rectangular holes 212*a* and 212*b* in the support frame 7 of the external casing plate 201. The pins 210 projecting from the casing 57 of the cassette 52 slide in the elongated holes 213 in the support frame 7 of the external casing plate 201 into contact with ends (upper ends in FIG. 14C) of the wall surfaces of the elongated holes 213 in the longitudinal direction (in the vertical direction in FIG. 14C).

This causes the support frame 7 of the external casing plate 201 to be secured between the external-casing positioning members 202*a* and 202*b* and the pins 210. This allows the external casing plate 201 to be moved by about 3 mm toward the front of the cassette 52 main body (downward in FIG. 14C) relative to the cassette 52 main body (casing 57) and be positioned.

When the sheets S to be stacked on the intermediate plate 58 in cassette 52 is of LGL size, the minor-axis portions of the substantially sector-shaped cassette positioning members 203*a* and 203*b* are in contact with the wall surfaces of the U-shaped slits 214*a*, as shown in FIG. 15C. Because of this, for the setting for LGL size (see FIG. 15C), the position of the casing 57 of the cassette 52 relative to the large-volume feeding deck 51 main body is shifted by about 3 mm from the position for setting for the A4 (FIG. 15B).

In other words, in this embodiment, the non-reference-side regulating members 204*a* and 204*b* and the rear-end regulating member 206 serving as regulating members respectively rotate 90 degrees about the shafts 211*a* to 211*c* from the state of setting for A4 size (FIG. 13B) in the direction of arrow C in FIG. 13B, as shown in FIGS. 13B and 13C.

This changes the contact surface between the side edge of the sheets S and the non-reference-side regulating members 204*a* and 204*b* and the rear-end regulating member 206 from the state of setting for A4 size (FIG. 13B) to the state of setting for LGL size (FIG. 13C). The amount of movement of the contact surface is 6 mm.

Referring to FIGS. 15B and 15C, the amount of movement of the cassette positioning members 203*a* and 203*b* is 3 mm, which is the difference in length between the major-axis portion and the minor-axis portion.

Accordingly, the amount of movement of the contact surface between the side edge of the sheets S and the non-reference-side regulating members 204*a* and 204*b* and the rear-end regulating member 206 (FIGS. 13B and 13C) is set to be twice the amount of movement of the cassette positioning members 203*a* and 203*b* (FIGS. 15B and 15C) (=6 mm/3 mm).

This allows sheets S of LGL size to be stacked on the intermediate plate 58 without moving the reference-side regulating plate 111 (FIG. 11) relative to the casing 57 of the cassette 52 as for A4 size sheets S.

This ensures sufficient strength of the reference-side regulating plate 111 and prevents the reference-side regulating plate 111 from being bent even if the cassette 52 in which a large volume of sheets S are stacked on the intermediate plate 58 is moved with strength, allowing accurate positioning of the sheets S. The other configurations are the same as those of the first embodiment and offer the same advantageous effects.

The above configuration prevents a regulating member from being bent even if a cassette unit in which a large volume of sheets are stacked is moved with strength, allowing the sheets to be fed at a proper position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A sheet feeding apparatus comprising:

an apparatus main body, and a cassette unit detachable from the apparatus main body, the cassette unit being configured to hold a stack of sheets, the cassette unit including a regulating member that regulates an edge of two sides of the sheets stacked in the cassette unit, an external member forming an outer surface of the cassette unit, a positioning member configured to position the external member relative to the apparatus main body and an operating lever operable by a user;

wherein the operating lever causes the regulating member, the external member, and the positioning member to move in accordance with movement of the operating lever.

2. The sheet feeding apparatus according to claim 1, further comprising:

a connecting member connecting the operating lever, the regulating member, the external member, and the positioning member together, wherein the regulating member, the external member, and the position member are operatively connected by the connecting member to be positioned at predetermined positions by setting the operating lever to a predetermined sheet size.

3. The sheet feeding apparatus according to claim 1, wherein the regulating member, the external member, and the positioning member move relative to the cassette unit in a direction in which the cassette unit is inserted into the apparatus main body.

4. The sheet feeding apparatus according to claim 3, wherein an amount of movement of the regulating member is set to twice as large as an amount of movement of the positioning member.

5. The sheet feeding apparatus according to claim 1, wherein the regulating member is rotatable in the cassette unit, the regulating member being so configured as to regulate ends of sheets of different sizes by rotation.

6. The sheet feeding apparatus according to claim 1, wherein the regulating member includes:

a side regulating member configured to regulate a position of the sheet in a width direction by coming into contact with an end in a sheet feeding direction of the sheets stacked in the cassette unit; and a rear-end regulating member configured to regulate a position of the sheet in the sheet feeding direction by coming into contact with a rear end of the sheets in the sheet feeding direction, and wherein the rear-end regulating member and the side regulating member are operatively connected to be positioned at predetermined positions.

7. The sheet feeding apparatus according to claim 1, wherein the regulating member and the external member are operatively connected and the external member move in an opposite direction from the regulating member.

8. An image forming apparatus comprising:

an apparatus main body including an image forming unit that forms a toner image, and a cassette unit detachable from the apparatus main body, the cassette unit being configured to hold a stack of sheets, the cassette unit including a regulating member that regulates an edge of two sides of the sheets stacked in the cassette unit, an external member forming an outer surface of the cassette unit, a positioning member configured to position the external member relative to the apparatus main body and an operating lever operable by a user;

wherein the operating lever causes the regulating member, the external member, and the positioning member to move in accordance with movement of the operating lever.

* * * * *